United States Patent [19]

Ogawa

[11] 4,243,312

[45] Jan. 6, 1981

[54] ELECTROPHOTOGRAPHIC COPYING APPARATUS

[75] Inventor: Masaya Ogawa, Osaka, Japan

[73] Assignee: Minolta Camera Kabushiki Kaisha, Osaka, Japan

[21] Appl. No.: 946,831

[22] Filed: Sep. 28, 1978

[30] Foreign Application Priority Data

| | | | |
|---|---|---|---|
| Oct. 11, 1977 | [JP] | Japan | 52-122107 |
| Oct. 11, 1977 | [JP] | Japan | 52-122108 |
| Dec. 19, 1977 | [JP] | Japan | 52-153205 |
| Dec. 19, 1977 | [JP] | Japan | 52-171196[U] |

[51] Int. Cl.[3] ..... G03G 15/28; G03G 15/32

[52] U.S. Cl. ..... 355/8; 355/11; 355/57

[58] Field of Search ..... 355/3 R, 8, 11, 55, 355/56, 57, 60, 66

[56] References Cited

U.S. PATENT DOCUMENTS

| | | | |
|---|---|---|---|
| 3,684,367 | 8/1972 | Vassitch | 355/11 |
| 3,884,574 | 5/1975 | Doi et al. | 355/8 X |
| 3,917,393 | 11/1975 | Nier | 355/8 X |
| 4,007,986 | 2/1977 | Komori et al. | 355/57 |
| 4,080,057 | 3/1978 | Nakane et al. | 355/11 |
| 4,080,062 | 3/1978 | Torigai et al. | 355/8 X |
| 4,095,880 | 6/1978 | Shogren et al. | 355/8 |
| 4,116,561 | 9/1978 | Knechtel et al. | 355/8 X |
| 4,125,323 | 11/1978 | Ikeda et al. | 355/8 |
| 4,139,298 | 2/1979 | Tani | 355/8 |

*Primary Examiner*—Fred L. Braun

*Attorney, Agent, or Firm*—Wenderoth, Lind & Ponack

[57] ABSTRACT

An electrophotographic copying apparatus which is capable of copying in different copying magnifications from an original to be copied onto a copy material. The copying apparatus includes an optical unit having a frame, and a lens and at least one reflecting mirror attached to the frame as one unit so that accurate variation in the magnifications is readily achieved by merely displacing the optical unit in parallel relation to its initial position.

17 Claims, 27 Drawing Figures

I
E
A1 (A2)
3
M1
M2
Z
2
L1
L2
N1
N2
4
B1
B2
D
8s
8
7
7a
α

ELECTROPHOTOGRAPHIC COPYING APPARATUS

BACKGROUND OF THE INVENTION

The present invention relates to an electrophotographic copying apparatus and more particularly, to an electrophotographic copying apparatus equipped with an improved variable magnification arrangement.

It has been a recent trend that electrophotographic copying apparatuses, for example, of the slit exposure type, in which either a platform to hold an original to be copied thereon or an optical system is adapted to move for exposing a photosensitive image forming surface to light images of the original in a known manner, are provided with a variable magnification arrangement mainly for copying of the original on a reduced scale for efficient business transactions and filing of copied documents and the like.

Commonly, for the projection of light images of the original onto an image forming surface through a lens or lens assembly, the following relations are established.

$$\left.\begin{aligned} am &= \left(\frac{m+1}{m}\right)f \\ bm &= (m+1)f \end{aligned}\right\} \quad (1)$$

where am represents the length of the light path between the original and the lens assembly, bm denotes the length of the light path between the lens assembly and the image forming surface, f is the focal length of the lens assembly, and m is the projecting magnification represented by (bm/am).

The length lm of light path between the original and image forming surface, i.e. the conjugate distance, is represented by $$lm = am + bm = \frac{(m+1)^2}{m} f$$

as is well known to those skilled in the art.

In connection with the above, if the projecting magnification m is varied, the length am of the light path between the original and lens assembly, the length bm of the light path between the lens assembly and the image forming surface, and the conjugate distance lm are naturally altered accordingly.

Therefore, in the optical systems of the conventional copying apparatuses, it has been a general practice for varying magnifications to move the position of the lens assembly and simultaneously to alter the position of the original or that of the reflecting mirror provided on the light path for the variation of the length of the light path between the original and the surface on which the image of the original is to be projected.

The conventional arrangement as described above, however, has the disadvantage that for the variation of the magnifications, two components, for example the lens assembly and flat reflecting mirrors, must be moved, individually or in association with each other, precisely in positions corresponding to the magnifications, this purpose, expensive and complicated moving means of high precision is inevitably required.

Furthermore, in the conventional copying apparatuses, the parts are arranged so that the position for illuminating the original and position for starting scanning of the original are set to be constant irrespective of copying magnifications so that the copying is initiated from a leading edge of the original during copying at the magnification of 1 i.e. in equal size copying. In the copying apparatuses as described above, if the scanning exposure is effected during reduced size copying in a similar manner as in the equal size copying, the leading edge of the original is not copied in the reduced size copying, since the scanning speed during the reduced size copying is faster than that during the equal size copying. For overcoming the inconvenience as described above, a delay mechanism is generally provided for delaying the timing for scanning the original during the reduced size copying.

However, providing the delay mechanism as described above not only complicates the construction of the copying apparatus to that extent, but increases the cost thereof, since change-over means is required for the delay function.

Meanwhile, in the known slit exposure type copying apparatuses, for making the variation and distribution of the exposure amount due to alteration of the copying magnifications uniform so as to solve the problem related to uneven density of copied images, a slit forming member or slit plate forming one side of a slit is arranged to be moved into or away from an image forming light path in association with the variation of copying magnifications to alter the configuration of the slit, but such an arrangement also requires a special mechanism for the purpose, making the construction of the copying apparatus more complicated, while a particular structure is necessary for correctly setting the slit configuration, thus resulting in further complication and high cost of the copying apparatus on the whole.

SUMMARY OF THE INVENTION

Accordingly, an essential object of the present invention is to provide an electrophotographic copying apparatus which is equipped with an improved variable magnification arrangement wherein variations of the magnifications are effected extremely readily and accurately by merely moving an optical unit, with the surface of the original to be copied and the photosensitive surface on which light images of the original are projected being fixed.

Another important object of the present invention is to provide an electrophotographic copying apparatus which is equipped with an improved variable magnification arrangement of the above described type wherein a synchronizing adjustment of original scanning for positional alignment between the original and the surface on which the light images of the original are projected is not required, with substantial elimination of disadvantages inherent in the conventional electrophotographic copying apparatus of the kind.

A further object of the present invention is to provide an electrophotographic copying apparatus, for example the of slit exposure type, capable of varying copying magnifications which is equipped with an exposure adjusting arrangement wherein the amount of exposure and distribution of the amount of exposure can be made uniform, with accurate exposure adjustment being effected by a simple structure.

A still further object of the present invention is to provide a variable magnification arrangement and an exposure adjusting arrangement of the above described type which are stable in functioning and simple during construction, and which can be incorporated into the electrophotographic copying apparatus at low cost.

In accomplishing these and other objects, according to one preferred embodiment of the present invention, the electrophotographic copying apparatus which is capable of copying in different copying magnifications from an original to be copied onto a copy material includes a platform for supporting thereon the original to be copied, and optical means for projecting light images of said original onto a photosensitive member. The optical means further includes a frame, and a lens and at least one reflective member attached to said frame as one unit, and is arranged to cross an extended line of an optical axis in an incidence and an exit of said optical means. The copying apparatus also includes changing means for changing the copying magnifications of said projected light-wise images of said original, which changing means is arranged to move the frame of said optical means so as to change the ratio of the length between said original and said lens to the length between said lens and said photosensitive member, and thus the copying magnification of said projected light image of the original is altered.

By the arrangement as described above, it has been made possible to readily alter the copying magnifications by merely moving the optical unit, irrespective of the number of reflecting mirrors employed, while accurate variations of the magnifications can be made by the adoption of said optical unit having a single unit structure which has a simple construction and a low cost.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
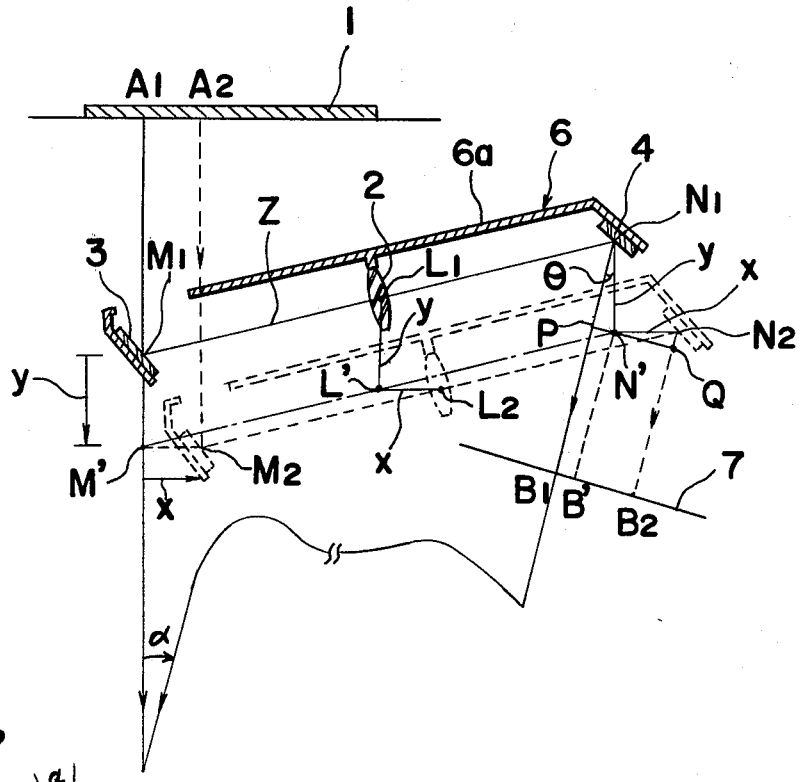
FIG. 1 is a schematic diagram explanatory of a structure of a variable magnification arrangement according to one preferred embodiment of the present invention.

Referring now to the drawings, there is diagrammatically shown in FIG. 1 the principle of the variable magnification arrangement according to the present invention.

In the arrangement of FIG. 1, solid lines represent the case where the magnification is $m_1$, and dotted lines show the case where the magnification is $m_2$, with the relation therebetween being $m_1 > m_2$. Below and adjacent to an original 1 to be copied which is illuminated by a suitable light source (not shown), there is disposed an optical unit 6 which includes a frame 6*a*, and a first reflecting mirror 3 provided at the left side of the frame 6*a* and suitably inclined to direct, through a lens assembly 2 mounted at an approximately central portion of the frame 6*a*, light rays from the original 1 towards a second reflecting mirror 4 disposed at the right edge of said frame 6*a* and also suitably inclined to direct the light rays from the first reflecting mirror 3 onto a projecting surface 7, for example, an electrophotographic photosensitive member, with the frame 6*a*, reflecting mirrors 3 and 4 and lens assembly 2 forming a single unit optical system 6.

In FIG. 1, the length am of the light path between the original 1 and lens assembly 2, the length bm of the light path between the lens assembly 2 and image surface on the projecting surface 7, and magnification m may be represented by the following equations when the equations (1) earlier described have the foregoing values therein:

$$am_1 = \overline{A_1M_1} + \overline{M_1L_1} = \frac{m_1 + 1}{m_1} \cdot f$$

$$bm_1 = \overline{L_1N_1} + \overline{N_1B_1} = (m_1 + 1) \cdot f$$

$$m_1 = bm_1/am_1$$

where $A_1$ and $B_1$ respectively represent points on the original 1 and projecting surface 7 intersected by an optical axis Z at the magnification $m_1$, while $L_1$, $M_1$ and $N_1$ respectively denote points at which the optical axis Z intersects the lens assembly 2 and flat reflecting mirrors 3 and 4 at the magnification of $m_1$.

When the optical unit 6 is displaced to alter the magnification to $m_2$, with the original 1 and projecting surface 7 fixed, the following equations may be established.

$$am_2 = \overline{A_2M_2} + \overline{M_2L_2} = \frac{m_2 + 1}{m_2} \cdot f$$

$$bm_2 = \overline{L_2N_2} + \overline{N_2B_2} = (m_2 + 1) \cdot f$$

$$m_2 = bm_2/am_2$$

wherein $A_2$, $B_2$, $L_2$, $M_2$ and $N_2$ represent points equivalent to the points $A_1$, $B_1$, $L_1$, $M_1$ and $N_1$ at the magnification $m_2$.

On the assumption that the displacement of the optical unit 6 in the axial direction of the incident light is represented by y, and displacement of the optical unit 6 in the direction normal to the incident light by x, and the angle formed by the incident light optical axis and final reflected light optical axis from the flat reflecting mirror 4 is represented by $\alpha$, following equations are established.

$$\begin{aligned} am_2 &= \overline{A_2M_2} + \overline{M_2L_2} \\ &= (\overline{A_1M_1} + y) + \overline{M_1L_1} \\ &= am_1 + y \end{aligned} \tag{2}$$

$$(\overline{M_2L_2} = \overline{M_1L_1} \,.\, \overline{A_1M_1} + \overline{M_1L_1} = am_1)$$

$$\begin{aligned} bm_2 &= \overline{L_2N_2} + \overline{N_2B_2} \\ &= \overline{L_1N_1} + \{\overline{N_1B_1} - (y\cos\alpha - x\sin\alpha)\} \\ &= bm_1 - (y\cos\alpha - x\sin\alpha) \end{aligned} \tag{3}$$

$$(\overline{L_2N_2} = \overline{L_1N_1} \,.\, \overline{L_1N_1} + \overline{N_1B_1} = bm_1)$$

More specifically, in FIG. 1, if intersecting points of the lens assembly 2 and reflecting mirrors 3 and 4 of the optical unit 6 with optical axis Z are designated by L', M', and N' when the optical unit 6 is displaced downwards by the distance y from the position shown in the solid lines, while perpendiculars are dropped to lines $\overline{N_1B_1}$ and $\overline{N_2B_2}$ from the point N', with the intersecting points designated as P and Q respectively, the relation will be $\angle PN_1N' = \angle QN'N_2 = \theta$ Meanwhile, from FIG. 1, the following relations are established, $$\overline{N_1B} = \overline{N_1P} + \overline{N_2Q} = \overline{N_2B_2}$$

$$\overline{N_1P} = \overline{N_1N'} \cdot \cos\theta = y\cos\theta$$

$$\overline{N_2Q} = \overline{N_2N'} \cdot \sin\theta = x\sin\theta$$

Since $\theta = \alpha$, $$\overline{N_2B_2} = \overline{N_1B_1} - (y\cos\alpha - x\sin\alpha)$$

In other words, the magnification is altered from $m_1$ to $m_2$ if values of x, y and $\alpha(=\theta)$ are selected to satisfy the above equations (2) and (3), and the displacement of the light path length am between the original 1 and lens assembly 2 is determined by the distance y, while that of the light path length bm between the lens assembly 2 and projecting surface 7 is determined by x, y and $\alpha$.

It is to be noted, however, that if $\alpha = 0°$ (i.e. if the incident light optical axis is parallel to the reflected light optical axis), $\cos\alpha = 1$ and $\sin\alpha = 0$, and thus, $$bm_2 = bm_1 - y$$

$$lm_2 = am_2 + bm_2 = am_2 + (bm_1 - y)$$

Upon substitution of the equation (2) thereinto, $$lm_2 = (am_1 + y) + (bm_1 - y) = am_1 + bm_1 = lm_1$$

and therefore, it is impossible to vary the conjugate distance.

In other words, it is necessary that the incident light optical axis not be parallel to the reflected light optical axis ($\alpha = 0°$) for making the magnification variable.

The variable magnification arrangement of the present invention will be explained more specifically with reference to FIG. 1.

On the assumption that the focal length f of the lens assembly 2 is 150 mm, and magnifications $m_1 = 1$ and $m_2 = 0.8$, values calculated from the equation (1) are $$am_1 = bm_1 = 300 \text{ mm}$$

$$am_2 = 337.5 \text{ mm}$$

$$bm_2 = 270 \text{ mm}$$

Upon substitution into the equation (2), $$y = am_2 - am_1 = 37.5 \text{ mm}$$

and when substituted into the equation (3), $$30 \text{ mm} = 37.5 \text{ mm} \cos\alpha - x\sin\alpha$$

On the supposition $\alpha = 30°$, $x \approx 4.95$ mm.

That is to say, for conversion from the equal size magnification to magnification of 0.8, the optical unit 6 has only to be moved downward by 37.5 mm and to the right by 4.95 mm in FIG. 1. Meanwhile, for the magnification conversion to 0.8 only through the downward displacement of the optical unit 6 without displacing said unit 6 to the right, the following relation is established on the assumption x=0.

$$30 \text{ mm} = 37.5 \text{ mm} \cos\alpha \alpha \approx 36.9°$$

In other words, if the angle $\alpha$ between the incident light optical axis and reflected light optical axis is 36.9°, projected image of 0.8 magnification can be obtained by merely moving the optical unit 6 downward by 37.5 mm in FIG. 1. The effect as described above is achieved even when one reflecting mirror or more than three reflecting mirrors are employed.

Figure 2:
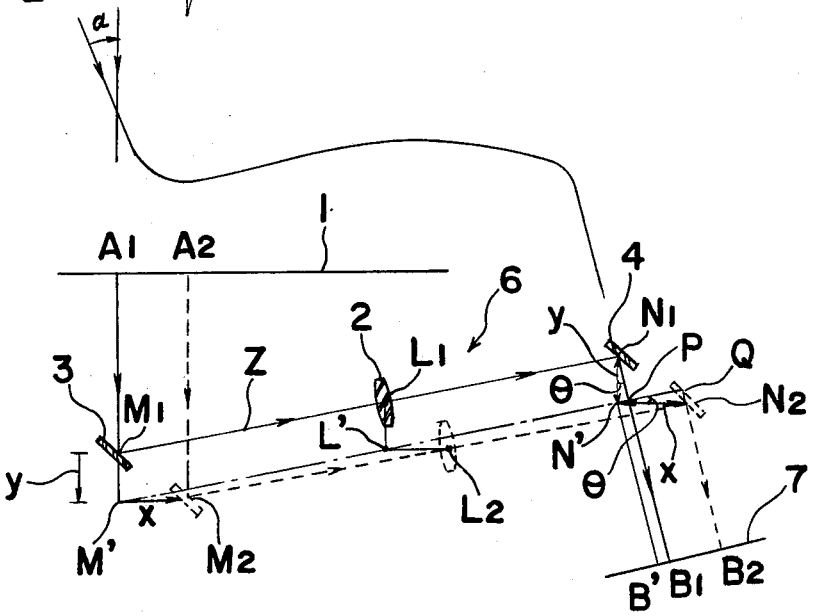
FIGS. 2 through 9 are views similar to FIG. 1; but particularly show modified structures thereof.

Referring to FIG. 2, there is shown a modification of the variable magnification arrangement of FIG. 1. It is to be noted here that in the drawings of FIG. 2 and thereafter, the frame 6*a* for holding the parts of the optical unit 6 is omitted for keeping the drawings simple.

In the modification of FIG. 2, the angles of the reflecting mirrors 3 and 4 in FIG. 1 are altered. When the equations (2) and (3) are denoted as $$\Delta a = am_2 - am_1$$

$$\Delta b = bm_1 - bm_2$$

and in the angle $\alpha$ between the incident light optical axis and reflected light optical axis, if the angle measured in the clockwise direction from the incident light optical axis is set to be positive $$\begin{aligned} \Delta a &= y \\ \Delta b &= y\cos\angle N'N_1P + x\sin\angle N_2N'Q \\ &= y\cos\theta + x\sin\theta \end{aligned} \quad (2')$$

and since $\theta = -\alpha$, the following equation is established.

$$\Delta b = y\cos\alpha - x\sin\alpha \quad (3')$$

Accordingly, on the basis of the equation (1) described earlier and equations (2') and (3'), by moving the optical unit 6 to satisfy the equations (2') and (3') in the similar manner as described with reference to FIG. 1, the magnification can be varied as desired.

Figure 3:
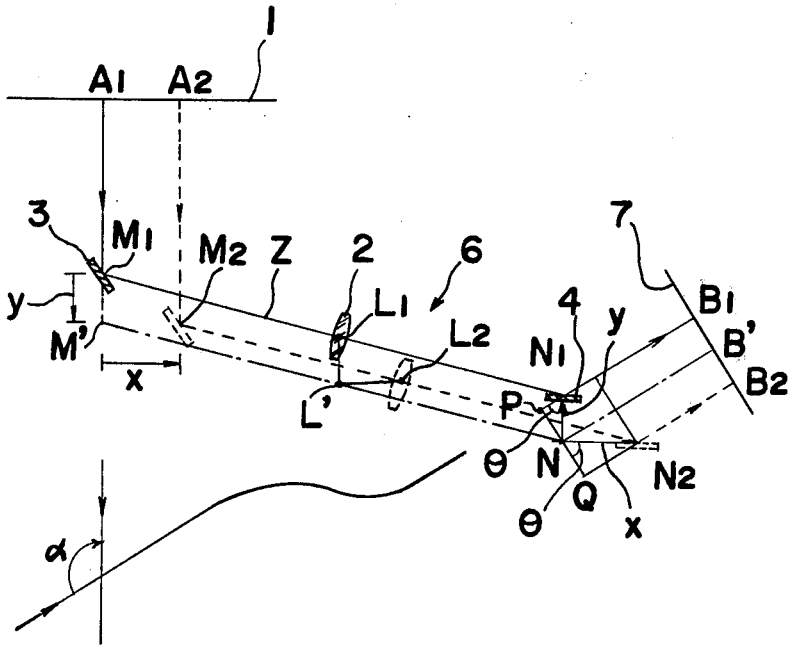

In the modification of FIG. 3, wherein the angles of the reflecting mirrors 3 and 4 described with reference to FIG. 1 are further modified, $$\begin{aligned} \Delta a &= y \\ \Delta b &= -y\cos\angle N'N_1P + x\sin\angle N_2N'Q \\ &= -y\cos\theta + x\sin\theta \end{aligned} \quad (2')$$

wherein $\theta = -(180-\alpha)$, and therefore, $$\Delta b = y\cos\alpha - x\sin\alpha \quad (3')$$

Figure 4:
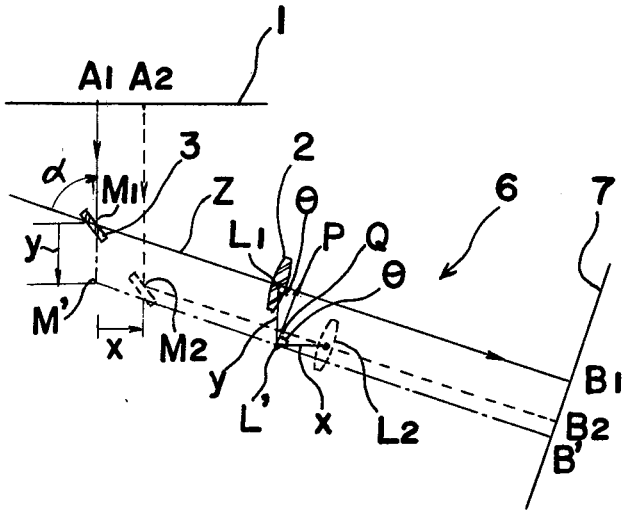

In another modification shown in FIG. 4 in which the reflecting mirror 4 described as employed in the arrangement of FIG. 1 is dispensed with, the following relation is established in the similar manner as in a foregoing embodiments.

$$\begin{aligned} \Delta a &= y \\ \Delta b &= y\cos\angle L'L_1P + x\sin\angle L_2L'Q \\ &= y\cos\theta + x\sin\theta \end{aligned}$$

wherein $\theta = -\alpha$, and therefore, $$\Delta b = y\cos\alpha - x\sin\alpha$$

Figure 5:
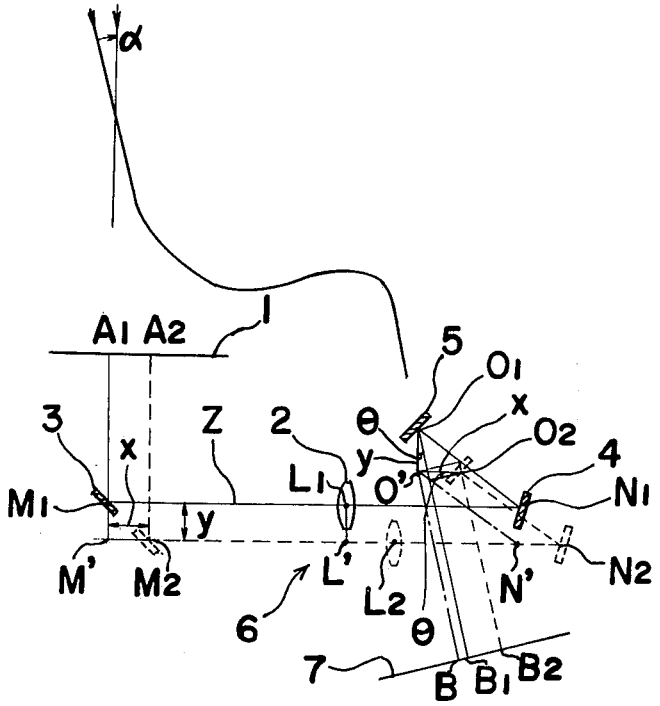

In a further modification shown in FIG. 5, the optical unit 6 in FIG. 1 is so modified as to include another reflecting mirror 5 disposed to receive the light reflected by the second mirror 4 for directing the reflected light toward the projecting surface 7 as shown.

$$\Delta a = y$$

$$\Delta b = y\cos\theta + x\sin\theta$$

where $\theta = -\alpha$, and thus $$\Delta b = y\cos\alpha - x\sin\alpha$$

Figure 6:
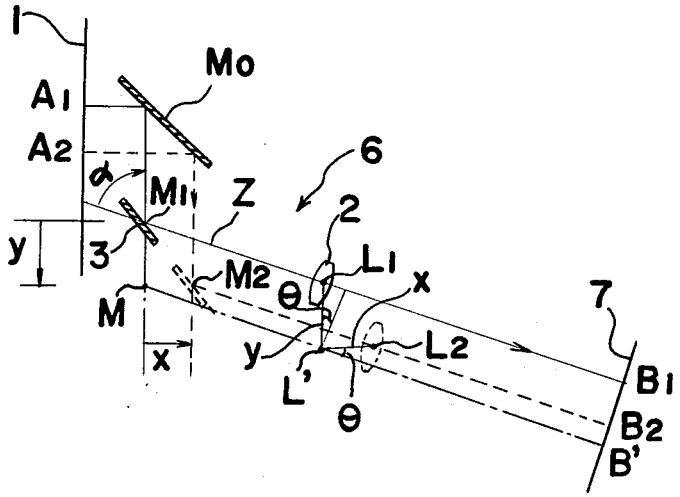

In a still further modification shown in FIG. 6, the reflecting mirror 4 described as employed in the arrangement of FIG. 1 is replaced by a fixed reflecting mirror Mo disposed between the original 1 and the reflecting mirror 3 for directing the light images of the original 1 to the projecting surface 7 via the reflecting mirror 3 and lens assembly 2. In this modification, $$\Delta a = y$$

$$\Delta b = y\sin\theta + x\cos\theta$$

where $\theta = -\alpha$, and therefore, $$\Delta b = x\cos\alpha - y\sin\alpha$$

It should be noted here that in the foregoing description, although the variations of magnifications are described with reference to the optical distance of the optical axis for the lens, such magnification variations may be effected in exactly the same manner if the optical distance on the lens optical axis satisfies the foregoing equations, even when the projection is effected by utilizing only oblique light deviated from the lens optical axis, for example, when a mirror lens assembly is employed.

As is clear from the foregoing description, according to the arrangement of the present invention, the projecting magnifications can be readily varied by merely moving the optical unit to satisfy the equations (2) and (3), irrespective of the number of the reflecting mirrors. Furthermore, accurate magnification variations are available by the use of the optical unit having a simple integral construction which can be made at a low cost.

Applications of the variable magnification arrangements in the foregoing description of scanning type copying apparatuses will be described hereinbelow.

Figure 7:
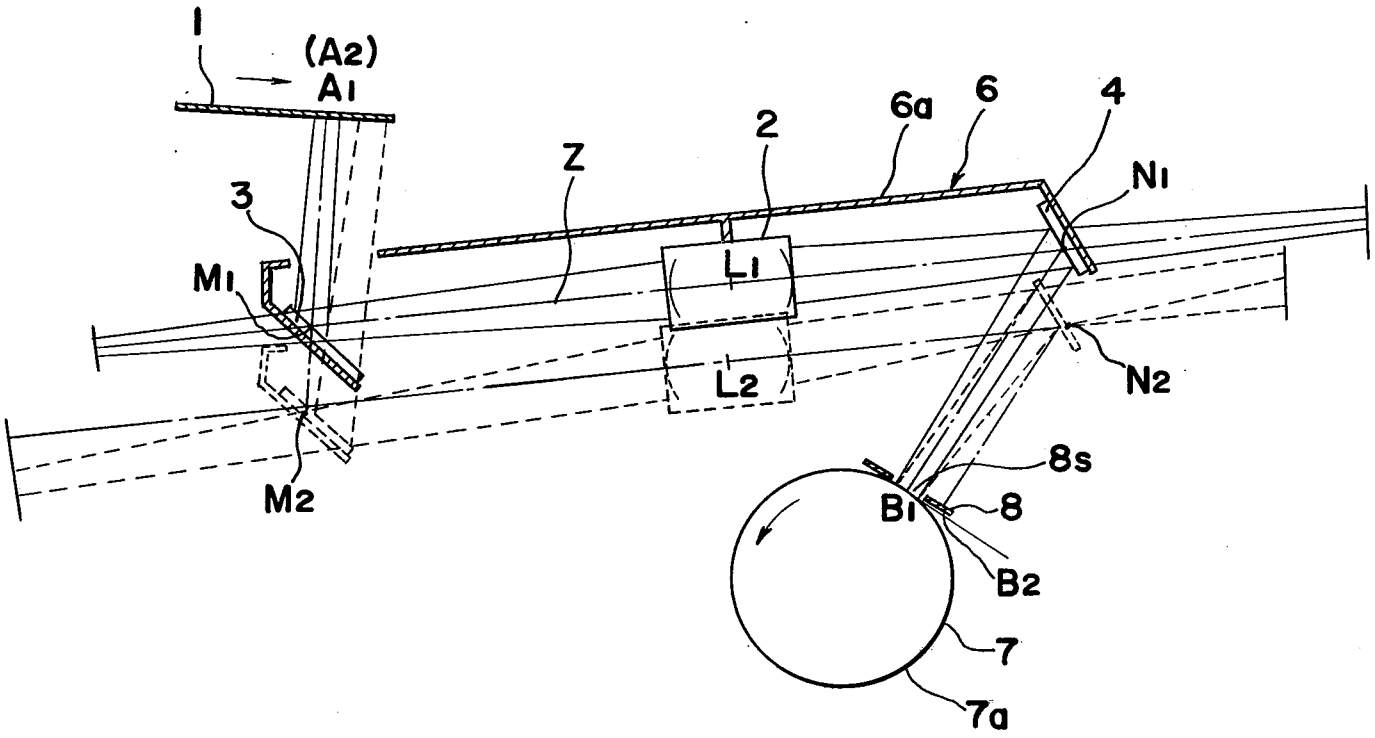

Referring to FIG. 7, the projecting surface 7 in the arrangements of FIGS. 1 to 6 is equivalent to the surface 7 of a photosensitive drum or photoreceptor 7*a* rotatably disposed below the optical unit 6, and the solid lines represent the positions of the parts for equal size magnification, while the dotted lines denote the case for 0.8 magnification. More specifically, FIG. 7 relates to the case where the optical unit 6 is displaced only in the downward direction by a suitable means (not shown) as described with reference to FIG. 1. In the above case, however, when the optical axis Z is displaced for the magnification variation, with the projecting positions being altered from $B_1$ to $B_2$, the images projected on the photoreceptor surface 7 go out of focus especially at the position $B_2$, thus sharp and accurate images are not obtainable. Therefore, in the arrangement of FIG. 7 according to the present invention, a slit member 8 having a slit 8s formed therein is provided in the light path in a position adjacent to the photoreceptor surface 7 for maintaining the exposure region constant. In other words, in the arrangement of FIG. 7, the parts are so arranged that the projection is made at the same place on the photoreceptor surface 7 by utilization of the light along the lens optical axis equal size magnification, and utilization of oblique light which is the light at an angle to the lens optical axis Z for the varied magnification.

In the above case, it is also necessary, as in the conventional arrangements, to alter the relative speed between the original 1 and the photoreceptor 7*a* through selection of clutch means by a switch (not shown) actuated following movement of the optical unit 6 or through alteration of engagement of gears (not shown).

In the case of the scanning projection during relative movement of the original to be copied and the photoreceptor, with the optical unit 6 remaining stationary, if the moving speeds of the original and photoreceptor are denoted by $V_1O$ and $V_1P$ at the magnification $m_1=1$, and the moving speeds of the original and photoreceptor are denoted by $V_2O$ and $V_2P$ at the magnification $m_2=0.8$, $$V_1P/V_1O=m_1=1$$

$$V_2P/V_2O=m_2=0.8$$

In conventional practice, since the moving speed of the original is altered according to the variation of the magnifications, with the moving speed of the photoreceptor being kept constant, following relation is established $$V_1P = V_1O = V_2P$$
$$V_2O = \frac{1}{0.8} V_1O$$

In other words, when $m_2$ is 0.8 (reduced size copying), the moving speed of the original is increased to 1.25 times that at equal size magnification. Meanwhile, in FIG. 7, the optical axis positions $A_1$ and $A_2$ are not altered on the surface of the original by the magnification variations, but actual projected light flux is shifted toward the right during reduced size copying as is seen from FIG. 7, although positional alignment is possible for the above by proper timing adjustment between the original 1 and photoreceptor 7*a* or copy paper. Furthermore, the apparatus may be so arranged that the optical system is moved in the direction normal to the incident light optical axis during variations of the magnifications.

Figure 8:
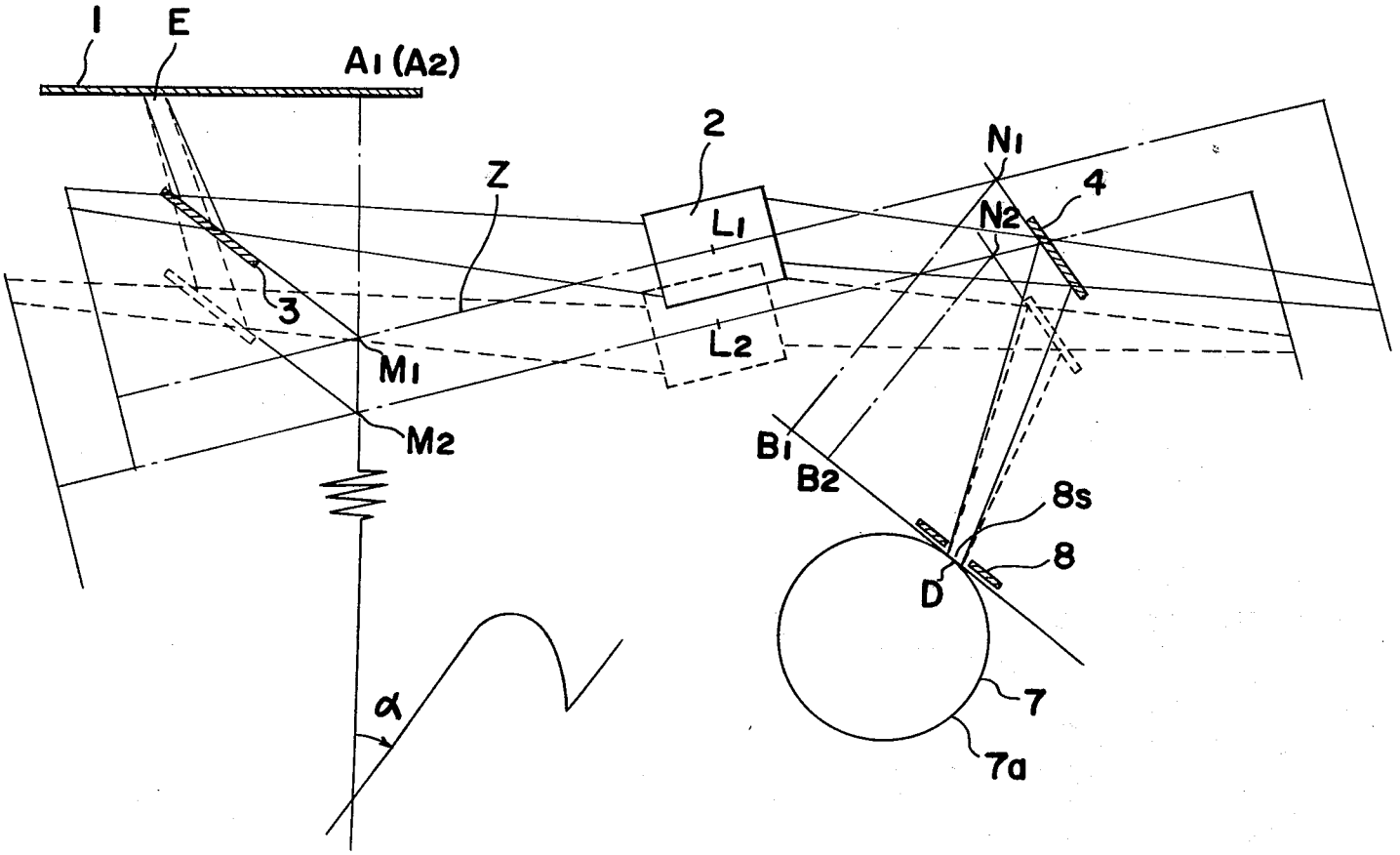

Referring to FIG. 8, there is shown a modification of the arrangement of FIG. 7. It is to be noted that in FIG. 8 described hereinbelow, the frame 6*a* for the integral formation of the optical unit 6 is omitted for simplicity of the drawings. In this modification, the oblique light is utilized both for equal size copying and reduced size copying for eliminating deviations in the projecting position on the surfaces of the original to be copied and of the photoreceptor, although in the arrangement of FIG. 7, the light on the lens optical axis is utilized for equal size magnification.

More specifically, when the optical unit 6 is moved vertically the distance y, and laterally the distance x, $$\overline{A_1E}=\overline{B_1D}/m_1$$

$$\overline{A_2E}=\overline{B_2D}/m_2$$

where E is the position of the original, and therefore, for the alignment of the position of the original $$\overline{A_1E_1}=\overline{A_2E}-x$$

$$\therefore \overline{B_1D}/m_1=\overline{B_2D}/m_2-x$$

where D is the projecting position.

On the basis of the relation $$\overline{B_1B_2} = \overline{B_1D} - \overline{B_2D}$$

-continued $$\overline{B_1D} = \overline{B_1B_2} + \overline{B_2D} = \overline{B_1B_2} + \frac{m_2\overline{B_1D}}{m_1} + m_2x$$
$$= \frac{m_1 \cdot \overline{B_1B_2} + m_1 \cdot m_2x}{m_1 - m_2}$$

Moreover, as is clear from the diagram of FIG. 1 explanatory of the principle of the present invention, $$\overline{B_1B_2} = y\sin\alpha + x\cos\alpha \tag{4}$$
$$\therefore \overline{B_1D} = \frac{m_1(y\sin\alpha + x\cos\alpha) + m_1 \cdot m_2x}{m_1 - m_2}$$

It is to be noted here that in FIG. 8, x is arranged to be 0.

In FIG. 8, on the assumption that the optical unit 6 is to be displaced only downwardly, with the focal length f of the lens assembly being 150 mm, and magnifications $m_1$ and $m_2$ being 1 and 0.8 respectively, $y=37.5$ mm, $x=0$, $\alpha=36.9°$, and $\overline{B_1B_2}=37.5$ mm, $\sin 36.9° \approx 22.5$ mm as is clear from the description with reference to FIG. 1, and from the equation (4), $$\overline{B_1D} = \overline{A_1E} = \frac{22.5 + 0.8 \times 0}{1 - 0.8} \approx 112.5 \text{ mm}$$

In other words, if oblique light offset from the optical axis by 112.5 mm ($\overline{A_1E}=\overline{B_1D}=112.5$ mm) is utilized for the equal size magnification, there are no deviations in the positions of the original and of the projected images on the photoreceptor surface even when the magnification is altered to 0.8 magnification by the downward displacement of the optical unit 6.

It is to be noted here that also in the case where the optical unit is moved laterally in the drawing, the object is achieved in a similar manner by satisfying the equation (4) described earlier.

Figure 9:
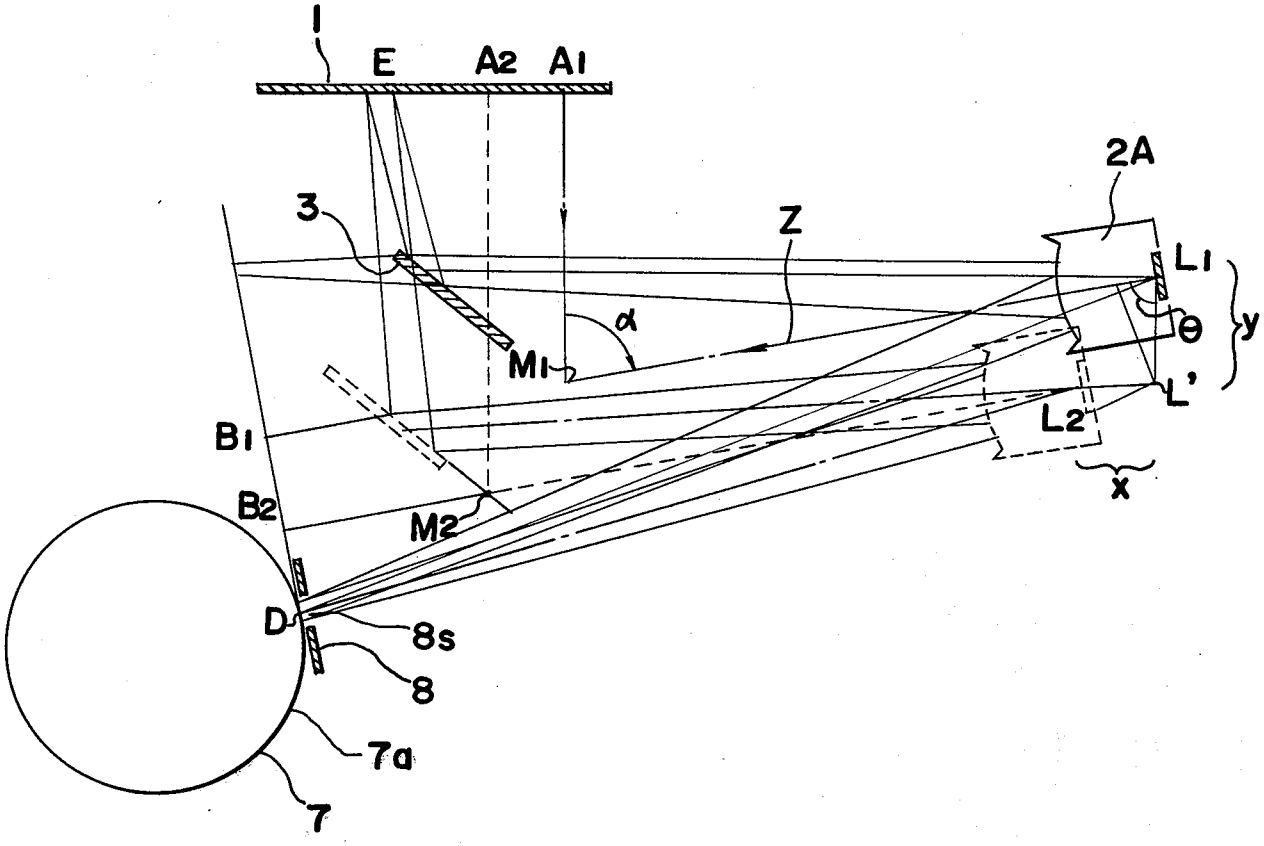

Referring to FIG. 9, there is shown another modification of the arrangement of FIG. 7. In this modification, the lens assembly 2 and reflecting mirror 4 described as employed in the optical unit 6 in FIG. 7 are replaced by a lens and mirror assembly 2A for utilizing the oblique light rays both for equal size and reduced size-copying.

From the equations (2') and (3') described earlier, $$\Delta a=y$$

$$\Delta b=\overline{L_1L'}\cos\theta+\overline{L'L_2}\sin\theta$$

and since $\theta=\alpha$, with x moved to the upper left portion in FIG. 9, $$\overline{L'L_2}=-x$$

$$\Delta b=y\cos\alpha-x\sin\alpha$$

In the drawing, the focal length $f=150$ mm, magnification $m_1=1.0$, magnification $m_2=0.8$ and angle $\alpha=80°$, and therefore, upon calculation in a similar manner as before, $$\Delta a = y = 37.5 \text{ mm}$$

$$\Delta b = bm_1 - bm_2 = 30 \text{ mm}$$

$$\therefore 30 \text{ mm} = 37.5 \text{ mm} \cos 80° - x \sin 80°$$

$$x \approx -23.9 \text{ mm}$$

$$\overline{B_1D} = \frac{(37.5\sin 80° - 23.9\cos 80°) - 0.8 \times 23.9}{1 - 0.8}$$

$$\approx 68 \text{ mm}$$

Since oblique light rays are employed, no deviation takes place on the surface of the original due to the variation of magnifications, if $\overline{A_1E} = \overline{B_1D} \approx 68$ mm.

Figure 10:
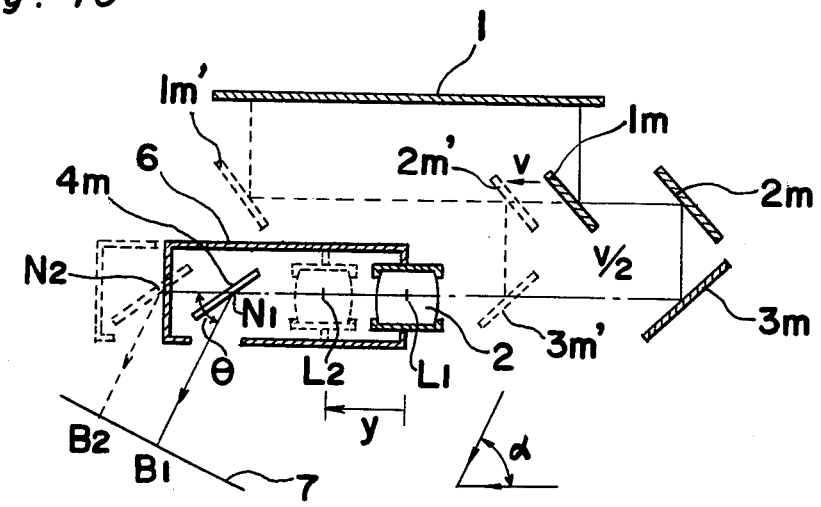
FIG. 10 is a schematic diagram showing a construction of the variable magnification arrangement of the present invention as applied to an optical system of an optical system moving type copying apparatus.

Referring to FIG. 10, there is shown the variable magnification arrangement of the invention as applied to an optical system moving type copying apparatus which employs the original scanning system disclosed, for example, in Japanese Patent Publication No. 39-6647. In FIG. 10, the optical system includes a first reflecting mirror 1*m*, and second and third reflecting mirrors 2*m* and 3*m* movably disposed below and adjacent to the original 1 to direct the light images of the original 1 toward the photoreceptor surface 7 through the optical unit 6 which further includes the lens assembly 2 and fourth mirror 4*m*. For the scanning of the original 1, the first mirror 1*m* is moved at a speed of V and the second and third mirrors at a speed of V/2 respectively in the direction indicated by arrows in the drawing, while the light images of the original 1 are sequentially projected onto the photoreceptor surface 7 through the reflecting mirrors 1*m*, 2*m* and 3*m*, and the lens assembly 2 and reflecting mirror 4*m* of the optical unit 6. When the optical unit 6 is moved toward the left in FIG. 10 by the distance y for the magnification variation, the images of the original 1 are projected onto the photoreceptor surface 7 on a reduced scale in the manner as described earlier. In this case, only the relation as follows has to be satisfied.

$$\Delta b = y \cos\theta = \overline{M_1M_2} \cos\theta$$

$$(\theta = -\alpha)$$

As is clear from the foregoing description, according to the present invention, since only the optical unit is arranged to be moved for the magnification variations, the images of the original to be copied can be extremely simply projected to the predetermined position on the photoreceptor surface. Furthermore, through utilization of the light beam or oblique light rays crossing the lens optical axis for the original projection, it is possible to maintain the original position and exposure position on the photoreceptor surface constant, irrespective of the variations in the magnification.

Figure 11:
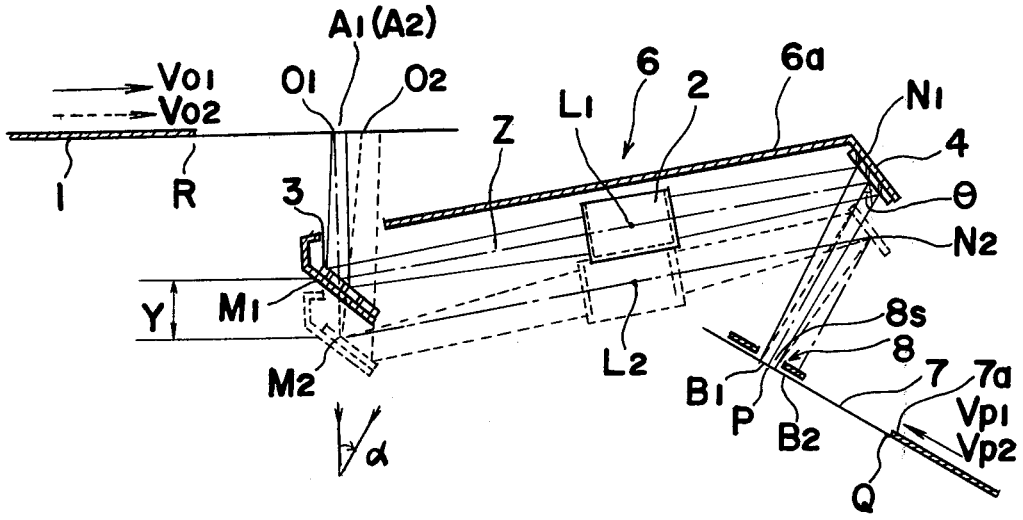
FIG. 11 is a view similar to FIG. 1, but further illustrates a structure of the variable magnification arrangement of the present invention in which the leading edge of the original is arranged to be aligned with the corresponding edge of the photoreceptor irrespective of copying magnification.

Referring now to FIG. 11, there is shown a further modification of the variable magnification arrangement of FIG. 1 wherein the leading edge of the original is arranged to be aligned with the corresponding edge of the photoreceptor, irrespective of copying magnifications.

In the modification of FIG. 11, the slit member 8 having the slit 8*s* is disposed in a position adjacent to the projecting surface 7, while the position of the leading edge of the original 1 is denoted by R, the position of the leading edge (whereat the starting signal for the original 1 is produced of the photoreceptor 7*a* by Q, the moving speeds of the original 1 for equal size copying and reduced size (×0.8) copying by $Vo_1$ and $Vo_2$, and the moving speeds of the photoreceptor 7*a* during the equal size copying and reduced size copying by $Vp_1$ and $Vp_2$ respectively.

The moving speeds of the original 1 and the photoreceptor 7*a* are in the relationship $Vo_1 = Vp_1$ for equal size copying, and $Vo_2 = Vp_2/0.8$ for reduced size copying.

Generally, copying apparatuses, have been so arranged that the moving speed of the original is altered for the variation of the projecting magnifications, since various problems are brought about in the developing and transfer if the moving speed of the photoreceptor is altered. Therefore, on the assumption that the moving speed of the photoreceptor 7*a* is V, $$Vo_2 = 1.25 \text{ V}$$

$$Vo_1 = \text{V}$$

Accordingly, for aligning the leading edge of the photoreceptor 7*a* with that of the original 1, the apparatus should be so arranged as to establish the relation $\overline{RO_1}/V = \overline{QP}/V$, i.e. $\overline{RO_1} = \overline{QP}$, for the equal size copying.

To align the leading edge of the original 1 with that of the photoreceptor 7*a* for exposure by displacing the original 1 irrespective of the magnifications when the leading edge of the photoreceptor 7*a* has reached the position Q, the relation is represented by $\overline{RO_2}/1.25\,V = \overline{QP}/V$, i.e. $\overline{RO_2} = 1.25\overline{QP} = 1.24\overline{RO_1}$ for reduced size copying. In other words, if the position of R satisfying the above relation $\overline{RO_2} = 1.25\overline{RO_1}$ is determined, the leading edge of the photoreceptor 7*a* and that of the original 1 coincide with each other, regardless of the magnifications.

Figure 12:
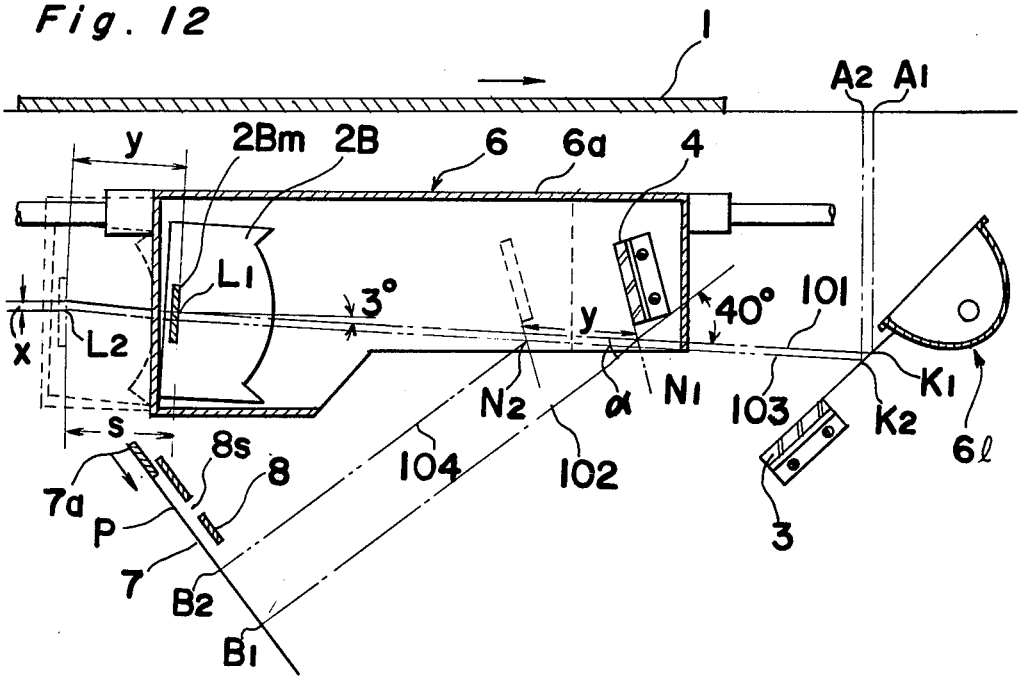
FIG. 12 is a schematic diagram showing a construction of the variable magnification arrangement of FIG. 11 as applied to an electrophotographic copying apparatus.

Referring to FIG. 12, there is shown a modification of the variable magnification arrangement of FIG. 11 as applied to an electrophotographic copying apparatus.

In the modification of FIG. 12, the reflecting mirror 3 and the lens assembly 2 described as employed in the optical unit 6 of FIG. 11 are replaced by a lens and mirror assembly 2B including a reflecting mirror 2Bm, with a light source 6*l* for the illumination of the original 1 provided at the right hand side of the drawing.

In the arrangement of FIG. 12, the original 1 moves at a speed equal to the photoreceptor 7*a* during equal size magnification, and at a speed 1.25 times (1/0.8) that of the photoreceptor 7*a* during reduced size (×0.8) copying respectively in the directions indicated by the arrow by changing over of clutch means 38 (FIG. 15) described later. In FIG. 12, the lens optical axis (optical axis of the light beam incident upon the optical unit 6) at equal size magnification is denoted by 101, the reflected light beam optical axis ($\overline{N_1B_1}$) during equal size magnification by 102, lens optical axis (optical axis of the light beam incident upon the optical unit 6) during reduced size (×0.8) copying by 103, the reflected light beam optical axis ($\overline{N_2B_2}$) during reduced size copying by 104, the intersection of an extension of the reflecting mirror 3 and the optical axis 101 by $K_1$, the intersection of an extension of the reflecting mirror 3 and the optical axis 103 by $K_2$, the intersection of an extension of the reflecting mirror 4 and the optical axis 101 by $N_1$, and the intersection of an extension of the reflecting mirror 4 and the optical axis 104 by $N_2$.

In the above arrangement, on the assumption that the focal length f of the lens and mirror assembly 2B is 150 mm, magnification $m_1$ is 1 and magnification $m_2$ is 0.8, $$am_1 = bm_1 = 300 \text{ mm}$$

$am_2 = 337.5$ mm $bm_2 = 270$ mm as explained with reference to FIG. 1, and from the equation (2), $$y = am_2 - am_1 = 37.5 \text{ mm}$$

Meanwhile, in FIG. 12, the optical axis of the lens and mirror assembly 2B is inclined downward by an angle of 3° with respect to the surface of the original 1.

Accordingly, on the supposition that the parallel displacement $\overline{L_1L_2}$ of the optical unit 6 with respect to the surface of the original 1 during the reduced size (×0.8) copying is denoted by S, $$S \cdot \cos 3° = y$$

$$S \cdot \sin 3° = x$$

and since y=37.5 mm, $$S = 37.5/\cos 3° \approx 37.55 \text{ mm}$$

$$x = 37.55$$

$$\sin 3° \approx 1.97 \text{ mm}$$

The angle $\alpha$ between the optical axis of the light beam incident upon the optical unit 6 and the optical axis of the light beam reflected therefrom is given as follows based on the equation 3 described earlier.

$$30 \text{ mm} = 3.75 \text{ mm} \cos \alpha - 1.97 \text{ mm} \sin \alpha$$

$$\therefore \alpha = -40°$$

Therefore, if the above conditions are satisfied, it is possible to alter the projecting magnification from 1 to 0.8 by moving the optical unit 6 in parallel to the surface of the original 1.

It should be noted here that in the arrangement of FIG. 12, the lens optical axis of the lens and mirror assembly 2B is inclined by the angle of 3° with respect to the surface of the original 1 only for a general description of the principle, and if it is directed in a direction parallel to the surface of the original 1, the value of x merely becomes equal to 0. Needless to say, even if the direction of movement of the optical unit 6 is not perfectly parallel to the surface of the original 1, the magnification variation is possible if the values of x and y satisfy the above equations.

Figure 13:
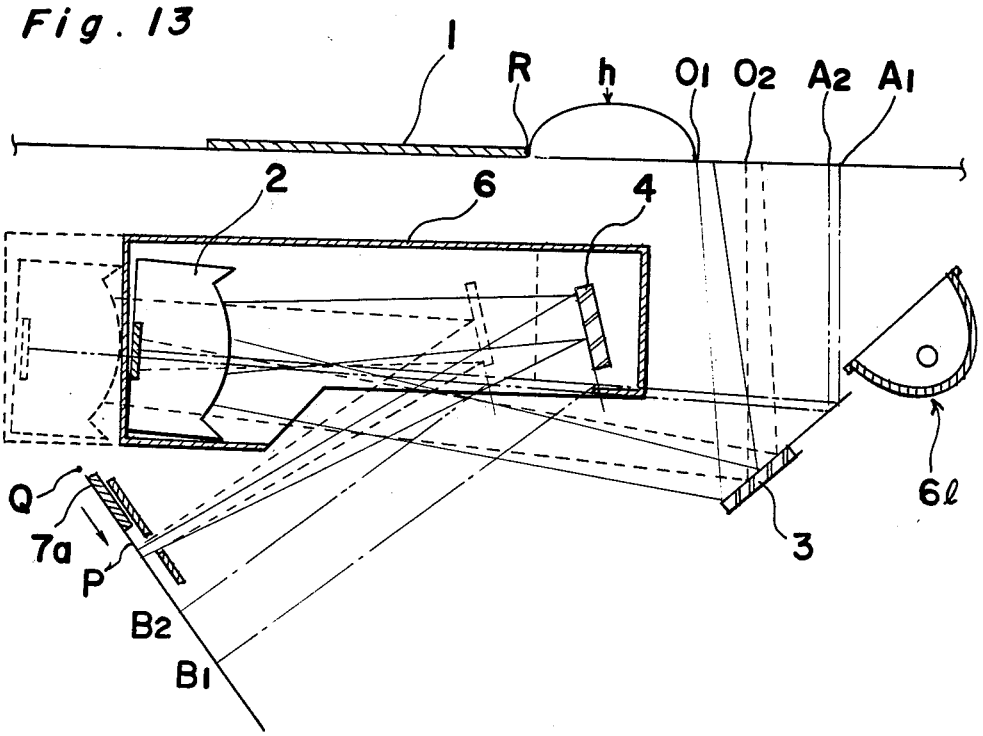
FIG. 13 is a schematic diagram explanatory of projection of light flux in the arrangement of FIG. 12.

Referring to FIG. 13, there is shown the state of projecting light flux in the arrangement of FIG. 12. It is to be noted that in FIG. 12, an oblique light beam is employed, since in the lens and mirror assembly, the optical axis of the light incident thereupon is equal to that of the light reflected thereby.

In FIG. 13, for equal size copying and reduced size copying, with the focal length f of the lens and mirror assembly set to be 150 mm, the optical axes on the photoreceptor surface are not aligned, and the amount $\overline{B_1B_2}$ of the deviation therebetween is $$\begin{aligned}\overline{B_1B_2} = \overline{PB_1} - \overline{PB_2} &= y\sin 40° - x\cos 40° \\ &= 37.5\sin 40° - 1.97\cos 40° \\ &= 22.6\end{aligned}$$

and $\overline{PB_1} = \overline{A_1O_1}$ (for equal size magnification)

$$\overline{PB_2} = \overline{A_2O_2} \times 0.8$$

Since the moving speeds of the photoreceptor 7a and the original 1 are constant during equal size magnification, $$\overline{QP} = \overline{RO_1} \text{ and } Vp_1 = Vo_1 = V$$

Subsequently, during reduced size copying, alteration is made only to the original moving speed $Vo_2$. In other words, the relations $Vp_1 = Vp_2 = V$ and $Vo_2 = Vp_2/0.8 = 1.25$ V are established, because alteration of the photoreceptor moving speed involves troublesome adjustments for the operations related to the photoreceptor 7a.

By the above arrangement, if the positions Q and R are set at points where the relation represented by the equation $\overline{OP}/V = \overline{RO_2}/1.25$ . . . (4) is established, the leading edge of the original 1 will be aligned with that of a copy to be made irrespective of whether the apparatus is operating for equal size copying or reduced size copying.

More specifically, on the assumption that $\overline{A_1O_1} = 45$ mm, for the equal size magnification, $$\overline{PB_1} = 45 \text{ mm, and}$$

$$\overline{PB_2} = \overline{PB_1} - \overline{B_1B_2} = 45 \text{ mm} - 22.6 \text{ mm} = 22.4 \text{ mm}$$

$$\overline{A_2O_2} = \overline{PB_2}/0.8 = 22.4 \text{ mm}/0.8 = 28 \text{ mm}$$

$$\overline{A_1A_2} = x = 1.97 \text{ mm}$$

$$\begin{aligned}\therefore \overline{O_1O_2} &= \overline{A_1O_1} - (\overline{A_1A_2} + \overline{A_2O_2}) \\ &= 45 \text{ mm} - (1.97 \text{ mm} + 28 \text{ mm}) = 15.03 \text{ mm}\end{aligned}$$

On the supposition that the moving speed of the original 1 during the equal size copying is 10 cm/sec, and that during the reduced size (×0.8) copying it is 12.5 cm/sec, and the distance between the leading edge of the original 1 and the point $O_1$, denoted by h, is $$h/100 = (h + 15.03)/125$$

$$\therefore h \approx 60 \text{ mm}$$

In other words, in the arrangement of FIG. 13, when the starting position R of the original 1 is set at a point 60 mm away from the original scanning position $O_1$ during the equal size magnification, leading edges of the original and photoreceptor will be aligned irrespective of whether equal size copying is being carried out or reduced size copying, even if the starting position of the original is constant. It is to be noted that if any mechanical side play, electrical delay or the like tend to take place at the starting of the original, such side play and delay may be taken into account for the setting at 60 mm.

Figure 14:
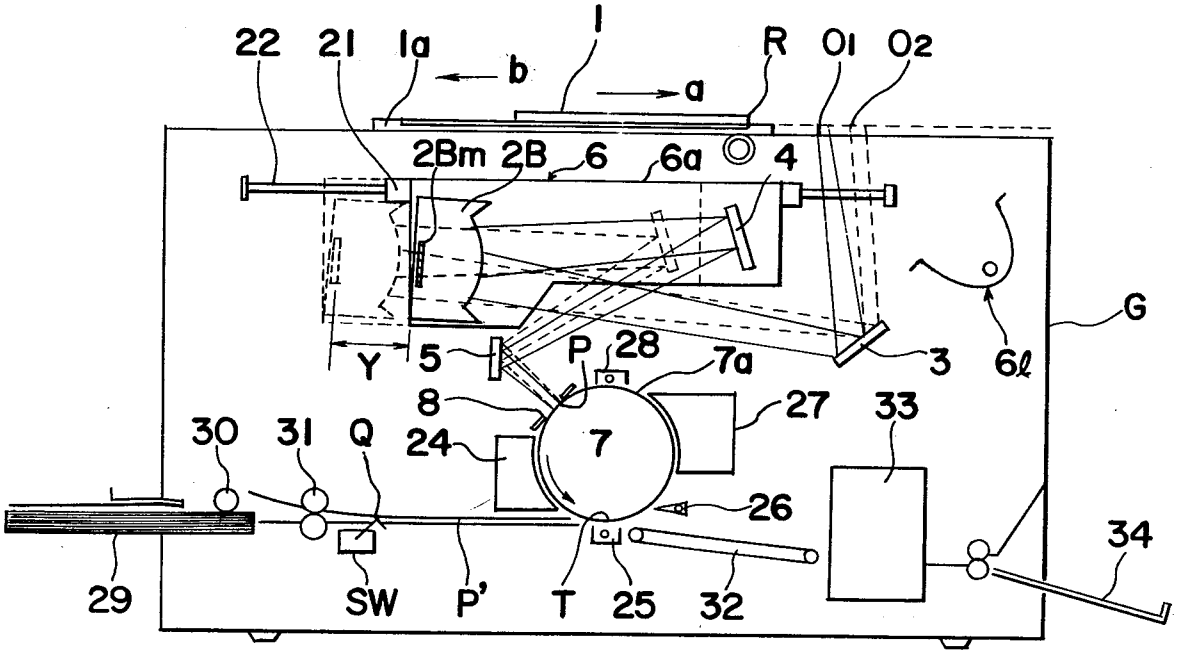
FIG. 14 is a schematic side sectional view of an electrostatic transfer type copying apparatus to which the variable magnification arrangement of the present invention may be applied.

Referring to FIG. 14, there is shown an electrostatic transfer type copying apparatus to which the variable magnification arrangement of the present invention may be applied.

In FIG. 14, the copying apparatus generally includes the photoreceptor drum 7*a* rotatably provided at an approximately central portion of an apparatus housing G, around which various processing devices such as a corona charger 28, the slit member 8, a developing device 24, a transfer charger 25, a separating claw 26, a cleaning device 27, etc. are sequentially arranged for carrying out copying operations in a known manner, while copy paper sheets accommodated in a cartridge or cassette 29 are arranged to be fed toward a transfer position T at the transfer device 25 by a feeding roller 30, and transportation rollers 31, and after the transfer, to be supplied into a fixing device 33 by a transportation belt 32 for subsequently being discharged onto a tray 34. Below and adjacent to a platform 1*a* for the original 1 provided at an upper portion of the housing G, there is disposed the optical unit 6 which includes the lens and mirror assembly 2B and reflecting mirror 4 secured to the frame 6*a* and slidably supported, by a sliding member 21, on a guide rod 22 secured to frames (not shown) of the housing G for movement toward the left in FIG. 14 by the distance Y during the reduced size magnification by driving means (not shown).

In the arrangement of FIG. 14, the copying apparatus further includes the flat reflecting mirrors 3 and 5 secured to the frames (not shown) of the apparatus housing G for directing the wise light from the original 1 onto the photoreceptor surface 7*a* together with the optical unit 6 to form a mirror image of the original 1 on said photoreceptor 7*a*.

For a copying operation, when the optical unit 6 is moved to a position corresponding to a desired magnification by change-over means such as lever means or the like (not shown), switch means (not shown) is actuated to select scanning clutches 43 and 46 (FIG. 15) described later for changing the moving speed of the platform 1*a*. In FIG. 14, the following relations are naturally established $$\overline{QP'} = \overline{RO_1}$$

$$\overline{PT} = \overline{P'T}$$

where P' is a point temporarily established. On the path of the copy paper in a position adjacent to the point Q, there is disposed a switch SW for detection of the arrival of the copy paper at the point Q to start the movement of the platform 1*a*.

A clutch mechanism including the scanning clutches 43 and 45 will be described hereinbelow with reference to FIGS. 15 and 16.

Along the lower surface at one side edge of the original platform 1*a*, there is formed a rack 37 with which a pinion gear 39 is engaged, and a pinion gear 40 integrally formed with the gear 39 is in mesh with the idle gear 41. The gear 41 is in turn engaged with a scanning gear 42 for equal size copying and which is rotatable simultaneously with a scanning sprocket 42*a* by the scanning clutch 43 for the equal size copying. The idler gear 41 is further engaged with a scanning gear 44 for reduced size (×0.8) copying and which is adapted to rotate simultaneously with a scanning sprocket 46 by the scanning clutch 45 for reduced size copying. The gear 44 is engaged, through an idle gear 50, with a return gear 47 which is arranged to rotate as one unit with the return sprocket 49 by a return clutch 48. The sprockets 42, 46 and 49 are in engagement with a chain 51 for being driven by a driving motor (not shown).

By the above arrangement, when the optical unit 6 is moved to the position of equal size copying shown by the solid lines in FIG. 14 by the change-over means, switch means (not shown) is actuated, and the equal size copying scanning gear 42 is connected with the scanning sprocket 42*a*, while the reduced size copying scanning clutch 45 is released, and the platform 1*a* being scanned in the direction indicated by the arrow a in FIG. 14. In the above case, the return clutch 48 is in the released state.

Upon arrival of the platform 1*a* at a predetermined position, the return clutch 48 is actuated by a detection switch (not shown), and the equal size copying clutch 43 is released. More specifically, the rotation of the return gear 47 is transmitted through the chain 51 to the return sprocket 49, return gear 47, idle gear 50, reduced size copying scanning gear 44, idle gear 41 and pinion gears 40 and 39, and thus, the platform 1*a* is returned in the direction indicated by the arrow b.

For reduced size copying, the scanning clutch 45 is actuated instead of the equal size copying scanning clutch 43 in a similar manner as described in the foregoing.

Figure 15:
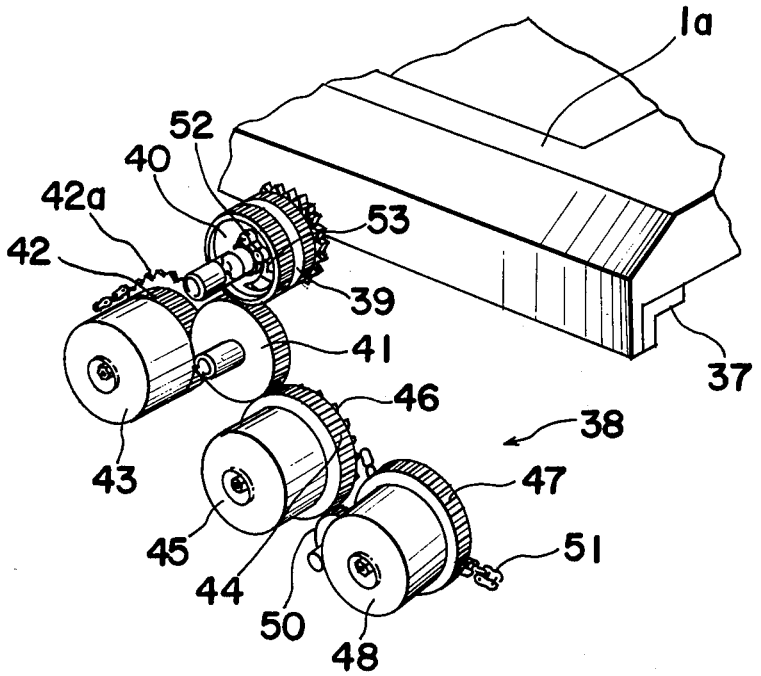
FIG. 15 is a perspective view of a clutch mechanism employed in the copying apparatus of FIG. 14.
Figure 16:
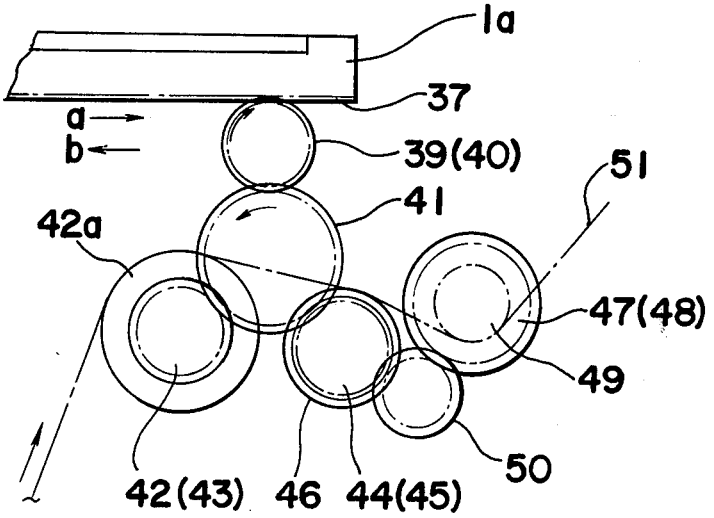
FIG. 16 is a schematic diagram explanatory of the clutch mechanism of FIG. 15.

It should be noted here that as shown in FIG. 15, the pinion gears 39 and 40 may be coupled to each other by pins 52 and an elongated opening 53 formed, for example, in the gear 40, to provide a certain side play therebetween for preventing slipping of the clutch due to inertia of the platform 1*a* during the change-over between copying and returning, in which case, however, it is necessary to adjust the timing for the movement of the platform 1*a* as mentioned earlier.

Figure 17:
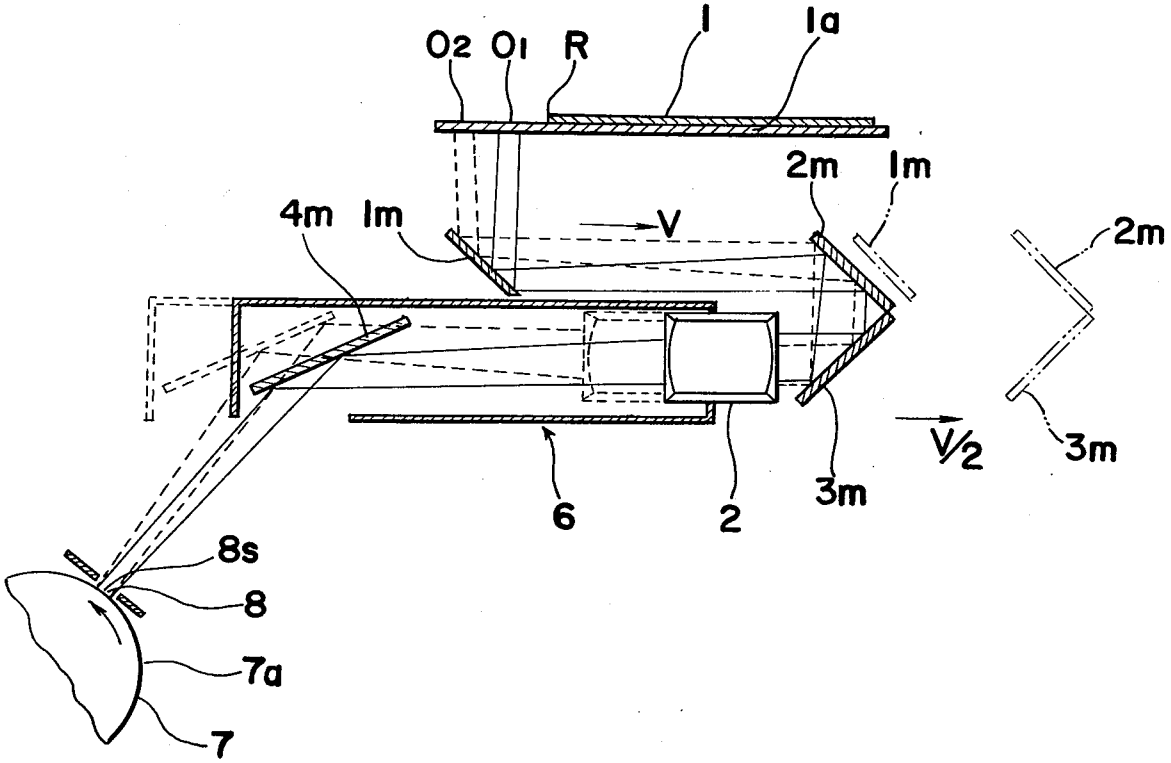
FIG. 17 is a schematic diagram showing the variable magnification arrangement of FIG. 11 as applied to an optical system moving type copying apparatus, FIG. 18(*a*) is a graph explanatory of light attenuation through an optical lens assembly, FIG. 18(*b*) is a schematic diagram explanatory of slit configurations, FIG. 18(*c*) is a graph explanatory of intensity of illumination on a surface of an original to be copied.

Referring now to FIG. 17, there is shown an application of the variable magnification arrangement of the present invention to an optical system moving type copying apparatus.

In the arrangement of FIG. 17, a scanning method for the original 1 as disclosed in Japanese Patent Publication No. 39/6647 is employed, and with respect to the original 1 on the platform 1*a*, the first reflecting mirror 1*m* is moved at a speed of V, while the second and third reflecting mirrors 2*m* and 3*m* are moved as one unit at a speed of V/2 respectively toward the right in the drawing. The light images of the original 1 are directed toward the photoreceptor drum 7*a* through the optical unit 6 including the fourth reflecting mirror 4*m* and lens assembly 2, and projected onto the photoreceptor surface 7 through the slit member 8 provided adjacent to the photoreceptor drum 7*a*. The scanning portion $O_1$ on the original surface corresponding to the slit of the slit member 8 scans the surface of the original 1 as the first mirror 1*m* moves.

For reduced size copying, the optical unit 6 is shifted to the position indicated by the dotted lines in FIG. 17 for reduced size projection.

In reduced size copying as described above, if the circumferential speed of the photoreceptor is the same as in the equal size copying, first, second and third reflecting mirrors 1*m* to 3*m* are each displaced at speeds obtained by multiplication of the speeds at equal size projection by reciprocals of the contraction rate. In the above case, the scanning position on the original surface corresponding to the slit 8*s* of the slit member 8 is shifted toward the left in FIG. 17 from the scanning portion $O_1$ for equal size copying to the position $O_2$ opposite to the direction of movement of the first reflecting mirror 1*m*, with the projection light path being shown by the dotted lines.

In the above case, since the scanning positions $O_1$ and $O_2$ at respective magnifications are different and moreover, the scanning position $O_2$ during the reduced size copying is provided at a point farther from the edge portion R of the original 1 than the scanning position $O_1$ for the equal size copying, if the first reflecting mirror 1*m* and original 1 are so positioned that the time required for the scanning positions $O_1$ and $O_2$ to move from the scanning starting position to the edge R of the original 1 following the displacement of the first reflecting mirror 1*m* becomes constant at each of the magnifications, the leading edge of the image of the original 1 projected on the surface 7 of the photoreceptor drum 7*a* is kept constant irrespective of the magnifications in a similar manner as in the arrangement of FIG. 11, and even when the transfer is effected onto a copy paper sheet (not shown), the leading edge of the original 1 is aligned with that of the copy paper sheet.

It should be noted here that in the foregoing embodiments, although the variable magnification arrangement is mainly described with reference to equal size copying and reduced size copying, the concept of the present invention is not limited in its application to such equal size copying and reduced size copying alone, but is readily applicable to equal size copying and enlarged size copying without any difficulty.

As is clear from the foregoing description, according to the present invention, variations of magnifications can be effected extremely simply and accurately by merely displacing the optical unit, and it is possible to align the leading edge of the original with that of the copy paper sheet, irrespective of the variation of the magnifications by adjustment of the starting position of the original or of the scanning mirror.

Figure 18:
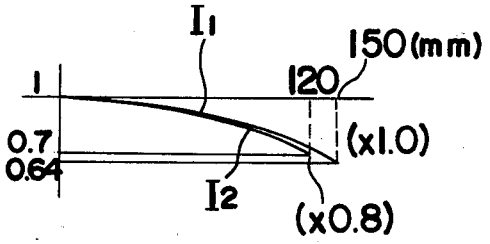
Figure 18:
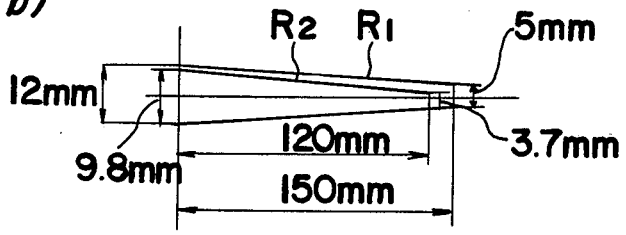
Figure 18:
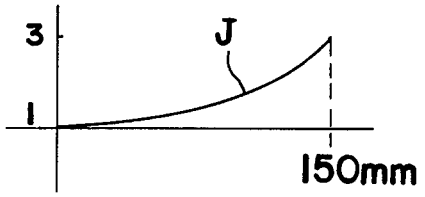

Referring now to FIGS. 18(*a*) through 25, applications of the variable magnification arrangement as described in the foregoing and an exposure adjusting arrangement to a slit exposure type copying apparatus will be described hereinbelow.

Generally, in slit exposure type copying apparatuses wherein the exposure is sequentially effected through an optical lens onto the rotating photoreceptor drum during movement of the image forming optical system or platform for the original to be copied, there has been a disadvantage that the resolution tends to deteriorate toward opposite ends of the photoreceptor drum in a direction away from the optical axis, thus resulting in indefinite copied images. This disadvantage as described above becomes especially conspicuous as the diameter of the photoreceptor drum is decreased. For overcoming the inconvenience as described above, there has conventionally been proposed a slit member having a slit the width which is gradually narrowed in directions away from the optical axis. In addition, optical lenses commonly have characteristics, such that the brightness of the edge of the image field or relative illumination thereof tends to be attenuated in proportion to $\cos^4$ of the incident angle $\theta$. Therefore, when optical lenses are employed as image forming means, the exposed surface illumination intensity is high (bright) in the vicinity of the optical axis, and becomes low (dark) as the distance from the optical axis is increased, thus resulting in uneven density of the copied images in the copying apparatuses. For example, light attenuation during equal size copying ($\times 1.0$) and reduced size copying ($\times 0.8$) at a focal length f of 150 mm is shown in the graph of FIG. 18(*a*) in which the distances from the lens optical axis on the exposure surface are along the abscissa and the ratio of light attenuation along the ordinate, with $I_1$ and $I_2$ representing equal size copying and reduced size copying respectively. For overcoming such light attenuation on the exposure surface as described above, constant illumination intensity can be achieved on the exposure surface, if the surface of the original is so arranged with respect to the illumination intensity distribution that the brightness is increased with an increase of the distance from the optical axis.

Furthermore, when a slit the width of which is gradually narrowed as the distance from the optical axis is increased, for example, one as represented by $R_1$ in FIG. 18(*b*), is employed, the illumination intensity distribution on the rotating photoreceptor may be uniform, but the exposure distribution is not still uniform. Therefore, if the illumination intensity on the original surface is set as denoted by J in FIG. 18(*c*), the distribution of the amount of exposure on the photoreceptor becomes uniform. In copying apparatuses in which copying magnification is variable, however, if the original surface illumination intensity distribution and slit configuration are set so that the distribution of the amount of exposure on the photoreceptor surface is made uniform during equal size copying, uneven density in the copied images takes place due to uneven distribution of the amount of exposure on the photoreceptor surface during reduced size copying or enlarged size copying due to variations of the angle of view of the effective F number by the alteration of the copying magnifications. The uneven density of the copied images can be eliminated by making uniform the variation of the amount of exposure due to the copying magnification alteration and the distribution of the amount of exposure by alteration of the slit shape according to each copying magnification, for example, alteration of the slit shape $R_1$ for equal size copying to a slit shape $R_2$ for reduced size ($\times 0.8$) copying as shown in FIG. 18(*b*). For this purpose in the copying apparatuses capable of changing copying magnifications, it has been a practice to provide a slit plate defining one side of the slit and arranged to be selectively moved into or retracted from the image forming light path in association with the alteration of the copying magnifications so as to alter the slit configuration for making uniform the exposure and distribution of the amount of exposure for any of the copying magnifications and for consequent prevention of the irregular density of the copied images.

The arrangement as described above, however, still has the disadvantages that separate mechanisms are required for associating the advancing and retracting of the slit plate with the copying magnification changing operation, with consequent complication in construction, and that, for accurately setting the slit configurations, a separate structure is required, thus resulting in further complication of the construction and high cost.

In the embodiments according to the present invention described hereinbelow, it is intended to provide an arrangement for adjusting the amount of exposure which may be used in a slit exposure type copying apparatus capable of varying copying magnifications, and which makes the amount of exposure and distribution of the amount of exposure uniform irrespective of the copying magnifications for accurate exposure adjustment by a simple construction.

More specifically, according to the arrangement of the present invention as described hereinbelow, in a slit exposure type copying apparatus in which copying magnifications are varied by displacing the optical unit including the lens assembly and at least one reflecting mirror, adjustable slit forming members for respective copying magnifications are provided in the image forming optical paths which are shifted as a result of alterations of the copying magnifications.

Figure 19:
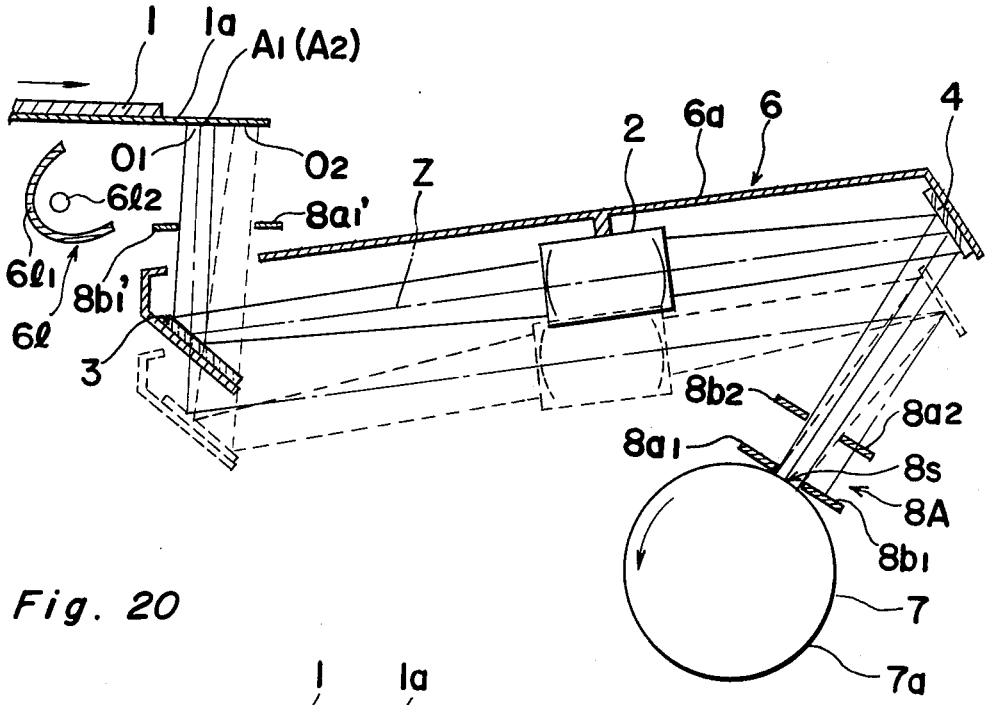
FIG. 19 is a schematic diagram similar to FIG. 7 and a structure of an exposure adjusting arrangement according to the present invention as applied to a slit exposure type copying apparatus.

Referring to FIG. 19, there is shown a main portion of a slit exposure type copying apparatus in which the variable magnification arrangement and exposure adjusting arrangement according to the present invention may be incorporated.

The construction of the copying apparatus of FIG. 19 is generally similar to that described with reference to FIG. 7 except for the inclusion of the particular slit structure 8A according to the exposure adjusting arrangement of the present invention. In FIG. 19, the platform 1*a* for carrying the original 1 to be copied thereon is movably disposed at the upper portion of the housing (not shown) of the copying apparatus for movement in the direction of the arrow by driving means (not shown), while the optical unit 6 which includes the reflecting mirrors 3 and 4 and lens assembly 2 accommodated in the frame 6*a* is displaceably provided below the platform 1*a* in the manner as described with reference to FIG. 7. Below and adjacent to the platform 1*a* at the left in FIG. 19, there is provided a light source 6l including a reflecting shade $6l_1$ and a lamp $6l_2$ for illuminating the original 1. Adjacent to the photoreceptor surface 7 along the reflected light path from the reflecting mirror 4, there is disposed the slit structure 8A including sets of slit forming members 8*a*1 and 8*a*2, and 8*b*1 and 8*b*2 for defining the slit 8*s* in the manner as described in detail later.

Figure 20:
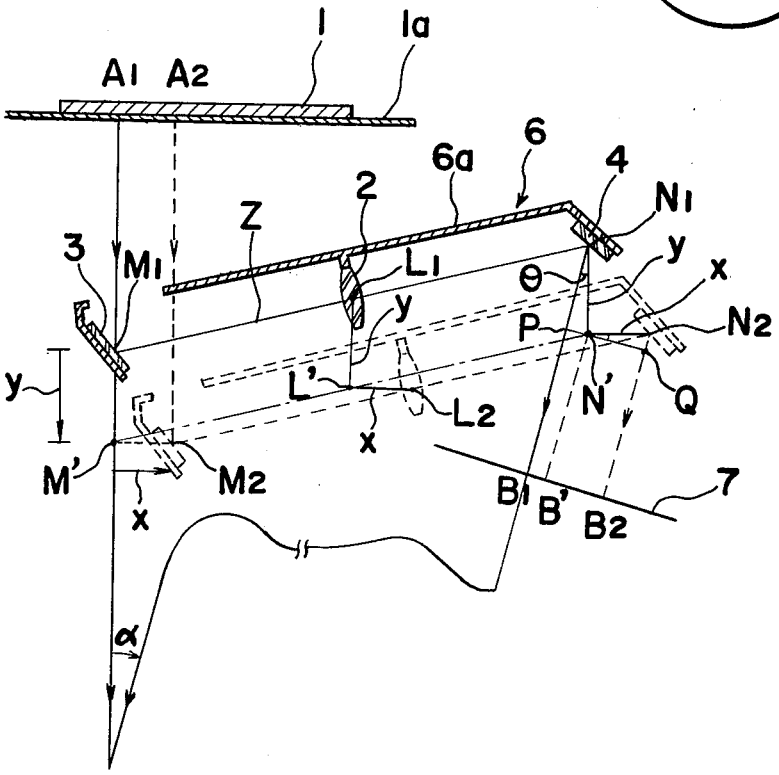
FIG. 20 is a schematic diagram similar to FIG. 1 and explanatory of the principle of magnification variation in the arrangement of FIG. 19.

In the construction of FIG. 19, the principle for changing the magnifications by movement of the optical unit 6 is shown in FIG. 20. Since the function related to the magnification variations is exactly the same as that described with reference to FIG. 1, a detailed description thereof is abbreviated here for brevity.

In FIG. 19, the positions of the optical unit 6 shown by the solid lines and dotted lines respectively represent the positions whereat the magnifications are $m_1$ and $m_2$ ($m_1 > m_2$) as described earlier with reference to FIG. 1.

It is assumed that, in the copying magnification $m_1$ of 1.0, i.e. in equal size copying, the platform 1*a* is moved in the direction of the arrow at a speed of $V_1$, while the photoreceptor drum 7*a* is rotated at a circumferential speed of $V_1$ in the direction indicated by the arrow. The moving original 1 is illuminated by the light source 6l at a position in the vicinity of the point $A_1$ which is the extension of the optical axis Z of the optical unit 6, i.e. at the original scanning position $O_1$ which is the position of the slit 8*s* corresponding to the original surface, and the light images of the original 1 are sequentially projected onto the photoreceptor surface 7 through the slit 8*s* defined by the slit forming members 8*b*1 and 8*b*2, while the image of the original 1 formed on the photoreceptor surface 7 is transferred onto a copy paper sheet (not shown) by known electrophotographic processes.

Subsequently, when the optical unit 6 is moved to the position indicated by the dotted lines in FIG. 19, i.e. to the position of the magnification $m_2$ for reduced size copying, since the copying magnification $m_2$ is smaller than the copying magnification $m_1$, the image of the original 1 is projected on a reduced scale onto the photoreceptor surface 7 of the photoreceptor drum 7*a*. With the copying magnification $m_2$ set at 0.8, if the circumferential speed $V_1$ of the photoreceptor drum 7*a* is to be maintained constant the moving speed of the platform 1*a* must be 1.25 $V_1$. In the above case, the light images of the original 1 are sequentially projected onto the photoreceptor surface 7 from the position of the slit 8*s* corresponding to the original surface, i.e. from the original scanning position $O_2$ through the optical unit 6 and via the slit 8*s* defined by the slit forming members 8*a*1 and 8*a*2. As described above, when the copying magnification is altered by movement of the lens 2 and reflecting mirrors 3 and 4 as one unit, with the images of the original 1 of different copying magnifications being formed at the same position, the original scanning positions $O_1$ and $O_2$ which are the positions on the photoreceptor surface 7 corresponding to the original surface, and the image forming light paths are altered.

As is seen from the foregoing description, the arrangement of FIG. 19 according to the present invention is characterized in the provision of the slit forming members exclusively for respective copying magnification in the image forming light paths which are different according to the copying magnifications. The slit forming members 8*b*1 and 8*b*2 for the magnification $m_1$, i.e. for the equal size copying restrict the equal size copying, image forming light path shown by the solid lines in FIG. 19 only during the equal size copying, and forms the slit 8*s* on the photoreceptor surface 7 as represented by $R_1$ in FIG. 18(*b*). The slit forming members 8*a*1 and 8*a*2 for the magnification $m_2$, i.e. for the reduced size copying of 0.8, restrict the reduced size copying light path denoted by the dotted lines in FIG. 19 only during the reduced size copying and form the slit 8*s* on the photoreceptor surface 7 as represented by $R_2$ in FIG. 18(*b*).

As stated in the foregoing, in the different image forming light paths according to the respective copying magnifications, if slit forming members which form slits corresponding to such copying magnifications are provided, it is not required to cause the movable slit member to be brought into or retracted from the image forming light path at every alteration of the copying magnification as in the conventional arrangements, and thus the exposure of the photoreceptor surface and distribution of the amount of exposure in the direction of the slit can be made uniform by a simple construction.

It should be noted here that in the foregoing embodiment, although the slit forming members 8*a*1 and 8*a*2, and 8*b*1 and 8*b*2 are described as provided between the lens assembly 2 and the photoreceptor 7*a*, the arrangement may, needless to say, be modified to install such slit forming members between the original 1 and lens assembly 2. It should also be noted that when the slit forming members are provided between the original 1 and the lens assembly 2, positional limitations on installing such slit forming members are small, since the amount of variation of the light path due to the movement of the optical unit is large. Furthermore, the arrangement may be so modified that one of the slit forming members, for example, the slit forming member 8*b*1′ is provided between the original 1 and lens assembly 2 so as to form the slit 8*s* for equal size copying with the slit forming member 8*b*2, while the other slit forming member 8*a*1′ is disposed between the original 1 and the lens assembly 2 so as to form the slit 8*s* for the reduced size copying with the slit forming member 8*a*2 as shown in FIG. 19.

In the foregoing description, the slit as shown in FIG. 18(*b*) is formed for making uniform the exposure and distribution of the amount of exposure on the photoreceptor surface on the assumption that the light source is subjected to illumination intensity variations having a simple variation curve as represented by J of FIG. 18(*c*). It is to be noted, however, that in the actual copying machine, the simple illumination intensity distribution as in FIG. 18(*c*) can not always be achieved, but complicated variations are involved due to the number of lamps, the shape of the reflecting shade, deviation in the quality of the lamps, differences in the position in which the reflecting shade is fixed, etc. Therefore, for achieving actual uniform exposure on the photoreceptor surface, it is necessary, beside the exposure and exposure distribution adjustments by the slit forming members which are different according to the copying magnifications as described earlier, to make further fine adjustments corresponding to the illumination intensity distribution on the surface of the original for each of the slit forming members.

Figure 21:
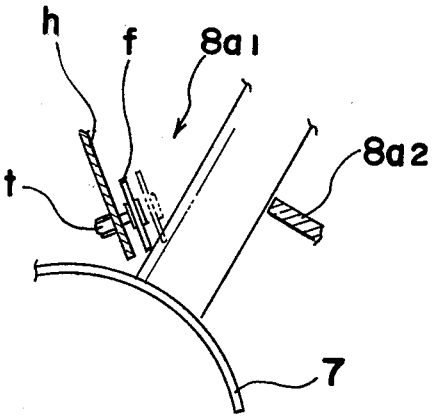
FIG. 21 is a schematic diagram showing a construction of a slit forming means employed in the arrangement of FIG. 19.
Figure 22:
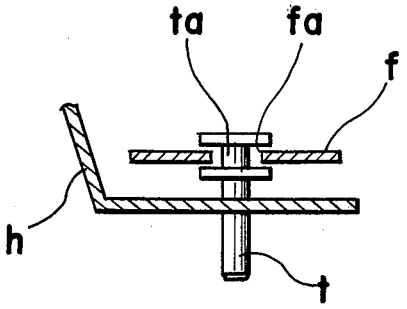
FIG. 22 is a fragmentary sectional view showing, on an enlarged scale, the slit forming means of FIG. 21.
Figure 23:
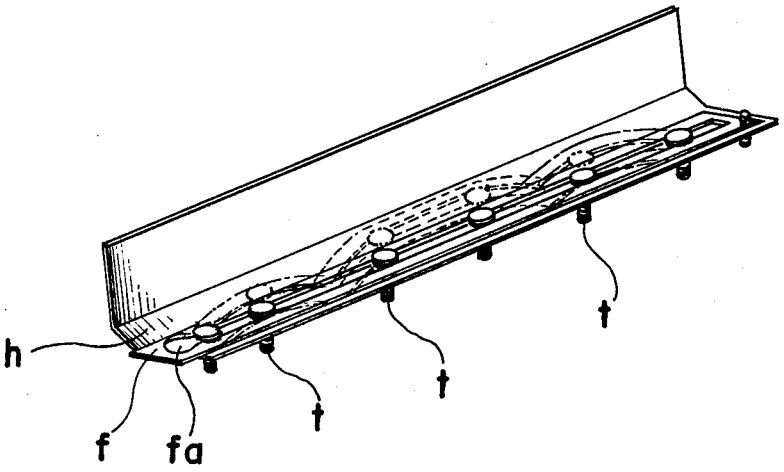
FIG. 23 is a perspective view of the slit forming means of FIG. 21.

For this purpose as shown in FIGS. 21 through 23, one member of the sets of the slit forming members, for example, the slit forming member 8*a*1 of the set of the slit forming members 8*a*1 and 8*a*2 is constituted by an exposure adjusting plate f of thin sheet-like material and disposed in a position confronting the other slit forming member 8*a*2 so as to be supported by a plurality of adjusting screws t screwed into corresponding threaded holes formed in a holder h which is suitably secured to a frame (not shown) of the copying apparatus. More specifically, each of the screws t has an annular groove ta at its head portion as shown in FIG. 22, and the edges of an elongated opening fa formed in the adjusting plate f are fitted into the groove ta for supporting the plate f by the screws t, and thus, the portions of the adjusting plate f corresponding to the positions of the screws t are raised or lowered following the vertical movement of the screws t. By the arrangement as described above, part of the adjusting plate f entering the light path intercepts the light for fine adjustment of the amount of light. The plurality of adjusting screws t make it possible to readily effect partial fine adjustment of the light amount. As is seen from the foregoing description, according to the arrangement of FIGS. 19 to 23 of the invention, the local fine adjustment of the amount of light is facilitated, with the slit forming members being exclusively provided for respective copying magnifications, and thus adjustments of the exposure and exposure distribution suited to respective copying magnifications can be readily achieved.

Figure 24:
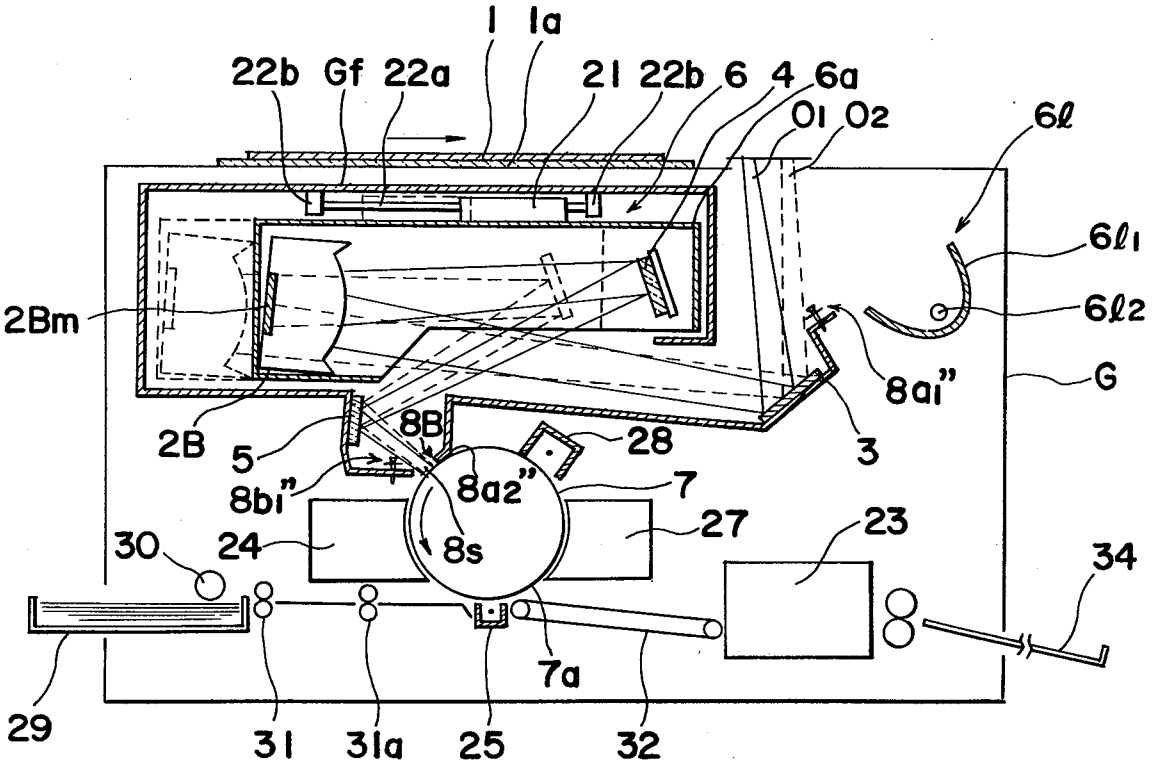
FIG. 24 is a schematic side sectional view of an optical system moving type copying apparatus with a variable magnification arrangement similar to that in FIG. 14 in which the exposure adjusting arrangement of FIG. 19 is incorporated.

Referring to FIG. 24, there is shown an application of the exposure adjusting arrangement to a copying apparatus which is equipped with the optical unit including the lens and mirror assembly and at least one flat reflecting mirror. The copying apparatus in FIG. 24 is generally similar in construction to that in FIG. 14 except for the inclusion of a modified slit structure 8B, and includes the platform 1*a* for holding the original 1 to be copied thereon movably disposed on the upper portion of the apparatus housing G for movement in the direction indicated by the arrow, the optical unit 6 including the lens and mirror assembly 2B having the reflecting mirror 2Bm and reflecting mirror 4 fixed to the frame 6, a sliding member 21 secured to the frame 6 and slidably fitted over a guide rod 22*a* held between holders 22*b* which are fixed to a frame Gf of the apparatus housing G, and the reflecting mirrors 3 and 5 secured to the frame Gf of the copying apparatus G and forming the image forming light paths for equal size copying (solid lines) and reduced size copying (dotted lines) as shown in FIG. 24 in cooperation with the optical unit 6 for projecting the light images of the original 1 onto the surface 7 of the photoreceptor drum 7*a* which is rotatably disposed at approximately the central portion of the apparatus housing G and around which processing devices such as the corona charger 28, slit 8*s*, developing device 24, transfer device 25, cleaning device 27, etc. are sequentially arranged in the known manner. The copy paper sheets stored in the cassette 29 are fed toward the transfer device 25 through the feeding roller 30, and transportation rollers 31 and 31*a*, and after the transfer, are supplied into the fixing device 33 by the transportation belt 32 are subsequently discharged onto the tray 34.

The light images of the original 1 are projected onto the photoreceptor surface 7 through the slit 8s formed by the slit forming member 8*a*2″ constituting a part of the frame Gf of the apparatus housing G and the corresponding slit forming member 8*a*1″ for equal size copying or 8*b*1″ for reduced size copying and having a construction similar to that shown in FIGS. 21 to 23.

In the above arrangement, the positions on the original 1 corresponding to the slit 8*s* are respectively represented by $O_1$ for equal size copying and by $O_2$ for the reduced size copying. At the left portion of apparatus housing G, there is disposed the light source 6l including the reflecting shade $6l_1$ and lamp $6l_2$ for illuminating the original 1. In equal size copying, the optical unit 6 is located in the position shown by the solid lines in FIG. 24, with the image forming light path for the equal size copying also shown by solid lines. In the above case, the slit 8*s* for equal size copying is formed by the slit forming members 8*b*1″ and 8*a*2″. Subsequently, the platform 1*a* starts moving simultaneously with actuation of the light source 6, and upon passing the position $O_1$, the light images of the original 1 are sequentially projected through the slit 8*s* onto the photoreceptor surface 7 of the photoreceptor drum 7*a* rotating at the circumferential speed equal to the moving speed of the platform 1*a*, and copied onto the copy paper in the known manner.

On the other hand, for reduced size copying, the optical unit 6 is displaced to the position shown by the dotted lines in FIG. 24, with the image forming light path for the reduced size copying also indicated by the dotted lines in the drawing. In this case, the slit 8*s* for the reduced size copying is formed by the slit forming members 8*a*1″ and 8*a*2″. The light images of the original 1 are projected onto the photoreceptor surface 7 of the drum 7*a* upon passing the position $O_2$, with the copying being effected in the similar manner as in a equal size copying.

It should be noted here, however, that if the rotating speed of the photoreceptor drum 7*a* is not altered for equal size copying and reduced size copying, the moving speed of the platform 1*a* during reduced size copying is equivalent to the reciprocal of the contraction rate.

As is seen from the foregoing description, according to the arrangement of the present invention, since the slit 8*s* is formed respectively by the slit forming members for equal size copying and for reduced size copying, slit configurations can be adjusted to shapes exclusively for the desired copying magnifications, with consequent facilitation of the adjustments of the exposure and distribution of the amount of exposure suitable for such copying magnifications.

Figure 25:
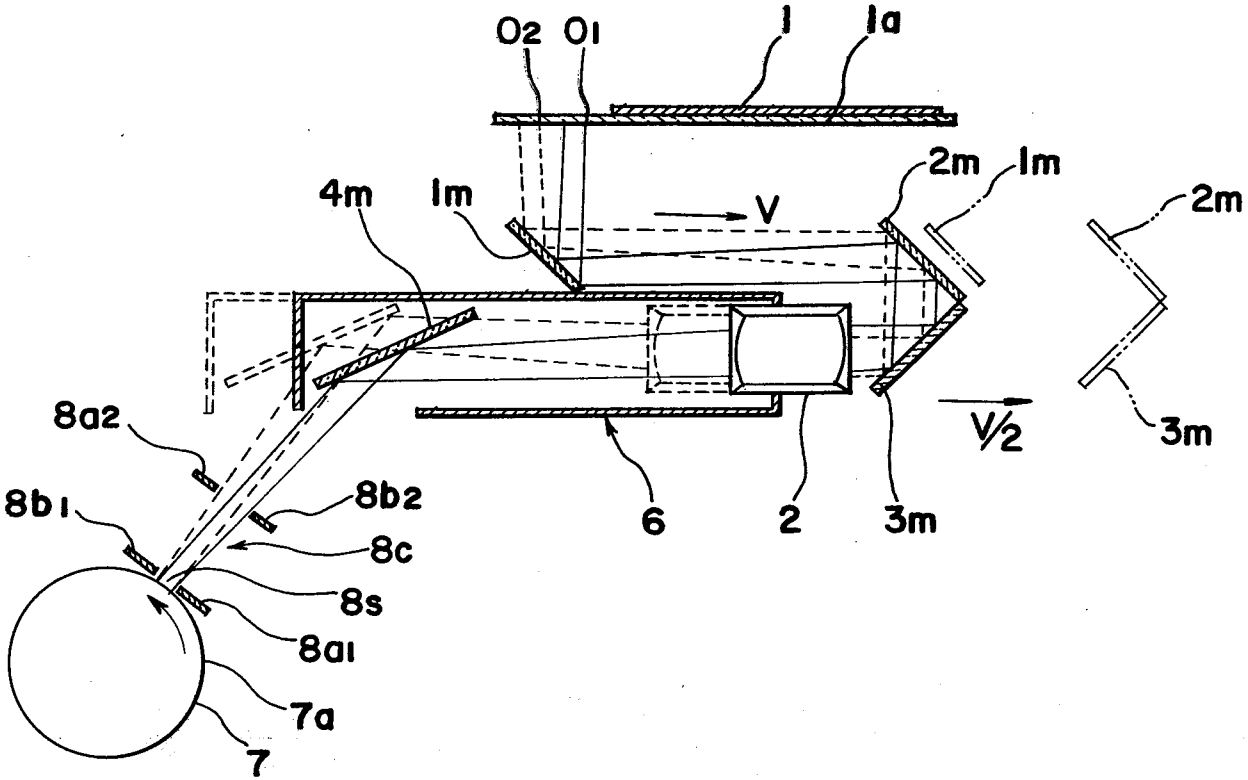
FIG. 25 is a view similar to FIG. 17, but particularly shows a modification thereof.

Referring to FIG. 25, there is shown an application of the exposure adjusting arrangement of the present invention to the optical system moving type copying apparatus. The construction of the copying apparatus of FIG. 25 is generally similar to that described with reference to FIG. 17 except for the inclusion of the exposure adjusting arrangement for the slit portions 8*c*, and the method disclosed in Japanese Patent Publication No. 39/6647 is utilized for scanning the original. In FIG. 25, with respect to the original 1 on the platform 1*a*, the first mirror 1*m* is moved at the speed V and second and third mirrors 2*m* and 3*m* are moved at the speed of V/2 respectively toward the right in the drawing. The light images of the original 1 are projected onto the surface 7 of the photoreceptor drum 7*a* by the optical unit 6 including the lens assembly 2 and fourth reflecting mirror 4*m* through the slit 8*s*. The scanning position $O_1$ on the surface of the original 1 corresponding to the slit 8*s* scans the original surface following the movement of the first mirror 1*m*.

For the variation of the magnifications, the optical unit 6 is displaced to the position indicated by the dotted lines in FIG. 25 to effect reduced size copying which has already been described in connection with FIGS. 10 and 17. In the above reduced size copying, if the circumferential speed of the photoreceptor 7*a* is maintained equal to that for the equal size projection, the first, second and third reflecting mirros 1*m*, 2*m* and 3*m* are respectively moved at the speed obtained by multiplying the speed for a equal size copying by the reciprocal of the contraction rate. In this case, the scanning position on the original surface corresponding to the slit 8*s* is located at $O_2$ as described with reference to FIG. 17, and the projecting light path at this time is shown by the dotted lines.

In the embodiment of FIG. 25, the projecting light paths are determined by the slit 8*s* which is formed by the slit forming members 8*b*1 and 8*b*2 for equal size copying and by the slit forming members 8*a*1 and 8*a*2 for reduced size copying respectively, for example, as represented by $R_1$ and $R_2$ in FIG. 18(*b*). These slit forming members 8*a*1 and 8*a*2, and 8*b*1 and 8*b*2 may be all formed by the members as described with reference to FIGS. 21 to 23 respectively or formed by such members as shown in FIGS. 21 to 23 only on one side of the slit forming members (for example, only the members 8*a*2 and 8*b*2).

It should be noted here that in the foregoing embodiments, although the present invention is mainly described with reference equal size copying and reduced size copying, the concept of the present invention is not limited in its application to the equal size copying and reduced size copying alone, but may readily be applied to equal size copying and enlarged size copying as well.

As is clear from the foregoing description, the slit exposure type copying apparatus of the present invention, in which the copying magnifications is changed by altering the projecting light paths through the movement of the optical unit, is provided with the adjustable slit forming members in the projecting light paths for respective copying magnifications, and thus it is possible to make the exposure and distribution of the amount of exposure uniform irrespective of the copying magnifications, with accurate exposure adjustments by a simple construction. Furthermore, the slit forming members including the adjusting plate which is selectively advanced into and retracted from the projection light path by the adjusting members such as screws and the like make it possible to accurately and simply adjust the slit configurations.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copying apparatus which is capable of copying an original at different copying magnifications, said copying apparatus comprising:

an original supporting surface on which the original to be copied is placed, said original supporting surface being at a stationary original plane;

a stationary projecting plane on which an image of said original is to be projected;

a photosensitive member movable along said projecting plane;

optical means between said original supporting surface and said projecting plane for projecting an image of the original from said original supporting surface onto said photosensitive member, said optical means including an optical unit having a frame with a lens and at least one reflective member attached to said frame to form a single unit, and said optical unit being positioned with the optical axis of said lens at the entry of said optical unit in nonparallel relation to an optical axis of said lens at the exit of said optical unit; and said optical unit being movable from a first position corresponding to a first magnification to a different position corresponding to a second magnification for changing the ratio of the length of said optical axis between said original supporting surface and said lens to the length of said optical axis between said lens and said projecting plane and thereby changing the copying magnification of said image of original projected on said projecting plane.

2. An electrophotographic copying apparatus as claimed in claim 1, wherein said optical unit being movable in a direction and by an amount to satisfy the equations, $$\frac{m_2+1}{m_2}\cdot f-\frac{m_1+1}{m_1}\cdot f=y$$

$$(m_1+1)f-(m_2+1)f=y\cos\alpha-x\sin\alpha$$

wherein $\alpha$ is the angle formed between said optical axis at the entry of said optical unit and said optical axis in said exit from said optical unit as measured in a clockwise direction, $m_1$ is the first copying magnification, $m_2$ is the second copying magnification, f is the focal length of said lens, y is the amount of displacement of said optical unit in the direction of the optical axis at the entry to said optical unit, and x is the amount of displacement of said optical unit in a direction normal to said optical axis at the entry to said optical unit.

3. An electrophotographic copying apparatus as claimed in claim 2, wherein said copying apparatus is the type wherein the original supporting surface is movable along said original plane at a speed corresponding to a selected copying magnification and said photosensitive member is movable along said projecting plane at a constant speed irrespective of the copying magnification.

4. An electrophotographic copying apparatus as claimed in claim 3, wherein said optical means includes slit defining means for defining a slit through which the image of the original is projected onto said photosensitive member from a scanning position of said optical means, said slit defining means being positioned to receive images from a different scanning position for each copying magnification and direct them onto the same position on said projecting plane.

5. An electrophotographic copying apparatus as claimed in claim 4, wherein said copying apparatus is the type wherein said supporting surface is movable for moving the original from a start position to arrive at the respective scanning positions at the same time in the cycle of operation of the apparatus.

6. An electrophotographic copying apparatus as claimed in claim 3, wherein said optical means includes slit defining means for defining a slit through which the image of the original is projected onto said photosensitive member from a scanning position of said optical means, said slit defining means being positioned to receive images from the same scanning position irrespective of the copying magnification and direct them onto the same position on said projecting plane.

7. An electrophotographic copying apparatus as claimed in claim 2, wherein said copying apparatus is the type wherein said original supporting surface is stationarily positioned along said original plane, and said optical means further includes a movable scanning mirror member between said original and said optical unit for directing the image of said original to said optical unit, said scanning mirror member being movable at a scanning speed relative to said original corresponding to the copying magnification and said photosensitive member being movable along said projecting plane at a constant speed irrespective of the copying magnification.

8. An electrophotographic copying apparatus as claimed in claim 7, wherein said optical means includes slit defining means for defining a slit through which the image of the original is projected onto said photosensitive member from a scanning position of said optical means, said slit defining means being positioned to receive images from a different scanning position for each copying magnification and direct them onto the same position on said projecting plane.

9. An electrophotographic copying apparatus as claimed in claim 8, wherein said scanning mirror member is movable from a start position toward one end of said original for moving the scanning position toward the end of the original from the scanning position at the start position of the scanning mirror member, said start position being such that the time required to reach from the scanning position at said start position to the end of the original is the same irrespective of the copying magnification.

10. An electrophotographic copying apparatus as claimed in claim 6, wherein said same position on said photosensitive member is related to the position at which the exit optical axis for the first copying magnification $m_1$ intersects the projecting plane according to the equation:

$$\overline{B_1D} = \frac{m_1(y \sin \alpha + x \cos \alpha) + m_1 m_2 x}{m_1 - m_2}$$

wherein $\overline{B_1D}$ is the distance between the position at which said optical axis for the first copying magnification $m_1$ intersects said projecting plane and said same position irrespective of the copying magnification.

11. An electrophotographic copying apparatus of the scanning exposure type which is capable of copying an ornginal at different copying magnifications, said copying apparatus comprising:

an original supporting platform on which the original to be copied is placed, said platform being movable along a stationary original plane;

a stationary projecting plane on which an image of said original is to be projected;

a photosensitive member movable along said projecting plane; and an optical means between said original supporting platform and said projecting plane for projecting an image of the original onto said photosensitive member, said original supporting platform and said photosensitive member being relatively movable so as to sequentially expose the image of said original onto said photosensitive member moved along said projecting plane through said optical means, said optical means including an optical unit having a lens and at least one flat reflecting mirror and having an incident optical axis and an exit optical axis which is in non-parallel relation to the incident optical axis, and said optical unit being movable from a first position to a second position while keeping said lens and reflecting mirror in parallel relation to the initial positions thereof for projecting an image of the original at a changed magnification onto a predetermined position on said photosensitive member whereby the copying magnification can be changed from a first to a second magnification by alteration of the scanning speed of said platform.

12. An electrophotographic copying apparatus as claimed in claim 11, wherein said optical unit is movable in a direction and by an amount to satisfy the equations:

$$\frac{m_2 + 1}{m_2} \cdot f - \frac{m_1 + 1}{m_1} \cdot f = y$$

$$(m_1 + 1)f - (m_2 + 1)f = y \cos \alpha - x \sin \alpha$$

$$\frac{v_1}{V_2} = \frac{m_2}{m_1}$$

wherein $\alpha$ is the angle formed between said incident optical axis and said exit optical axis as measured in a clockwise direction, $m_1$ is the first copying magnification, $m_2$ is the second copying magnification, f is the focal length of the lens, y is the amount of displacement of said optical unit in the direction of the incident optical axis, x is the amount of displacement of said optical unit in a direction normal to said incident optical axis, and $v_1$ and $v_2$ are the scanning speeds of the movable platform at said first and second copying magnifications respectively.

13. An electrophotographic copying apparatus of the scanning exposure type which is capable of copying an original at different copying magnifications, said copying apparatus comprising:

an original supporting surface on which the original to be copied is placed, said original supporting surface being at a stationary original plane;

a stationary projecting plane on which an image of said original is to be projected;

a photosensitive member movable along said projecting plane; and an optical unit between said original supporting surface and said projecting plane for projecting an image of the original onto said photosensitive member, said original supporting surface and said optical unit being relatively movable to sequentially expose the photosensitive member to the image of said original, slit defining means for defining a slit through which the image of the original is projected, said optical unit including a lens and at least one flat reflecting mirror and having an incident optical axis and an exit optical axis which is in non-parallel relation to the incident optical axis, said optical unit being movable from a first position to a second position while keeping said lens and reflecting mirror in parallel relation to the initial positions thereof for projecting an image of the original at a changed magnification onto said photosensitive member, said slit defining means being positioned for projecting the image of the original from a first scanning position on said original plane when said optical unit is in said first position and for projecting the image of the original from a second scanning position when said optical unit is in said second position, whereby the magnifications can be varied by changing the speed of relative movement of said original supporting surface and said optical unit.

14. An electrophotographic copying apparatus as claimed in claim 13, wherein said original supporting surface is movable with respect to said optical unit, said optical unit being positioned respectively at first and second positions when the copying magnification is at first and second magnifications respectively, and the first scanning position being posterior to the second scanning position with respect to the direction of the movement of said original when the first magnification is smaller than the second magnification.

15. An electrophotographic copying apparatus as claimed in claim 14, wherein said copying apparatus is the type wherein said supporting surface is movable for moving the original from a start position to arrive at the respective scanning positions at the same time in the cycle of operation of the apparatus.

16. An electrophotographic copying apparatus of the mirror scanning type which is capable of copying an original at different copying magnifications, said copying apparatus comprising:

a stationary original supporting surface on which the original to be copied is placed;

a stationary projecting plane on which an image of said original is to be projected;

a photosensitive member movable along said projecting plane; and optical means between said original supporting surface and said projecting plane for projecting an image of the original onto said photosensitive member, said optical means including a movable mirror unit movable for scanning the original on said original supporting surface and an optical unit which includes a frame, a lens and at least one flat reflecting mirror mounted on said frame with an incident optical axis and an exit optical axis in non-parallel relation, said mirror unit being movable relative to said photosensitive member for sequentially directing the image of the original on said original supporting surface through said optical unit onto said photosensitive member moved along said projecting plane, said optical unit being movable from a first position to a second position while keeping said lens and reflecting mirror in parallel relation to the initial positions thereof for projecting an image of the original at a changed magnification onto said photosensitive member whereby the copying magnification can be changed from a first to a second magnification by alteration of the scanning speed of said mirror unit.

17. An electrophotographic copying apparatus as claimed in claim 16, wherein said optical unit is movable in a direction and by an amount to satisfy the equations:

$$\frac{m_2 + 1}{m_2} \cdot f - \frac{m_1 + 1}{m_1} \cdot f = y$$

$$(m_1 + 1)f - (m_2 + 1)f = y \cos \alpha - x \sin \alpha$$

$$\frac{v_1}{V_2} = \frac{m_2}{m_1}$$

wherein $\alpha$ is the angle between said incident optical axis and said exit optical axis as measured in a clockwise direction, $m_1$ is the first copying magnification, $m_2$ is the second copying magnification, f is the focal length of said lens, y is the amount of displacement of said optical unit in the direction of said incident optical axis, and x is the amount of displacement of said optical unit in a direction normal to said incident optical axis, and $v_1$ and $v_2$ are the scanning speeds of said mirror unit at said first and second copying magnifications respectively.

* * * * *